US011358193B2

(12) United States Patent
Broeks et al.

(10) Patent No.: US 11,358,193 B2
(45) Date of Patent: Jun. 14, 2022

(54) METHOD FOR CHANGING THE ROLLS ON A ROLLING MILL

(71) Applicant: FIVES DMS, Noyelles-les-Seclin (FR)

(72) Inventors: Benoît Broeks, Hellemmes (FR); Aymeric Delanoy, Carvin (FR)

(73) Assignee: FIVES DMS, Noyelles-les-Seclin (FR)

( * ) Notice: Subject to any disclaimer, the term of this patent is extended or adjusted under 35 U.S.C. 154(b) by 547 days.

(21) Appl. No.: 16/094,793

(22) PCT Filed: Apr. 14, 2017

(86) PCT No.: PCT/EP2017/059057
§ 371 (c)(1),
(2) Date: Oct. 18, 2018

(87) PCT Pub. No.: WO2017/182406
PCT Pub. Date: Oct. 26, 2017

(65) Prior Publication Data

US 2019/0091744 A1 Mar. 28, 2019

(30) Foreign Application Priority Data

Apr. 18, 2016 (FR) ..... 16 53411

(51) Int. Cl.
*B21B 31/10* (2006.01)
*B21B 13/02* (2006.01)

(52) U.S. Cl.
CPC ..... *B21B 31/103* (2013.01); *B21B 31/10* (2013.01); *B21B 31/106* (2013.01); *B21B 2013/025* (2013.01); *B21B 2203/32* (2013.01)

(58) Field of Classification Search
CPC ..... B21B 31/103; B21B 31/10; B21B 31/106; B21B 31/08; B21B 31/18; B21B 2203/32;
(Continued)

(56) References Cited

U.S. PATENT DOCUMENTS 7,165,432 B2 1/2007 Berendes et al.
8,479,366 B2 7/2013 Cronier et al.
(Continued)

FOREIGN PATENT DOCUMENTS

CN 103286540 B 6/2015
DE 10 2009 037 665 A1 2/2011
(Continued)

OTHER PUBLICATIONS

International Search Report, dated Jul. 14, 2017, from corresponding PCT application No. PCT/EP2017/059057.
(Continued)

*Primary Examiner* — Teresa M Ekiert
*Assistant Examiner* — Sarkis A Aktavoukian
(74) *Attorney, Agent, or Firm* — Nixon & Vanderhye

(57) ABSTRACT

Disclosed is a method for changing the rolls on a rolling mill for rolling a metal strip, carried out using a Quarto rolling mill, including lower and upper working and support rolls. The installation includes a system for extracting the working rolls and the support rolls, including: an actuator pushing the rolls out of the roll stand extraction; a coupling head, secured to the actuator, situated in a position of opening of the roll stand, including: a first coupler driving the chock or the end of the lower working roll, on the rolling-mill drive side; a second coupler driving the chock of the lower support roll, on the rolling-mill drive side. The first and second coupler allow successive extractions of the working rolls and then of the support rolls from the roll stand using the actuator of the extraction system. Also disclosed is a related rolling mill installation.

20 Claims, 16 Drawing Sheets

(58) Field of Classification Search
CPC ... B21B 2013/025; B21B 31/16; B21B 31/32; B21B 31/22
See application file for complete search history.

(56) References Cited

U.S. PATENT DOCUMENTS

| | | | | |
|---|---|---|---|---|
| 9,061,334 | B2 | 6/2015 | Bender et al. | |
| 2002/0078728 | A1 | 6/2002 | Mukaigawa et al. | |
| 2005/0138982 | A1* | 6/2005 | Berendes | B21B 31/103 72/239 |

FOREIGN PATENT DOCUMENTS

| | | | | |
|---|---|---|---|---|
| JP | S62234606 | A | * | 10/1987 |
| JP | S63174708 | A | * | 7/1988 |
| KR | 20090059930 | A | | 6/2009 |
| WO | 03/099479 | A1 | | 12/2003 |

OTHER PUBLICATIONS

Examination Report issued in Indian Patent Application No. 201817039271 dated Sep. 10, 2020.

* cited by examiner

FIG. 32
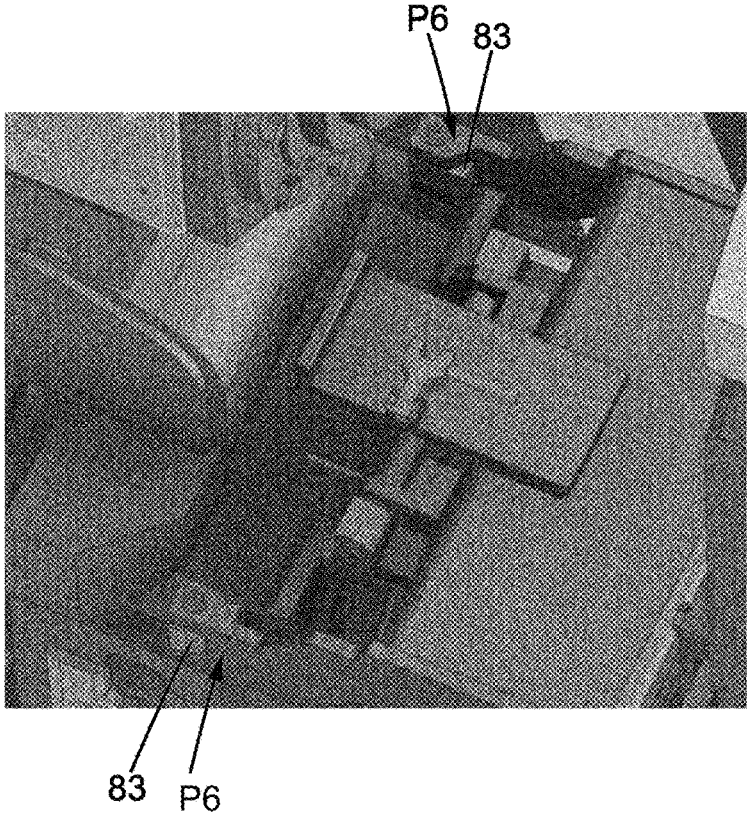
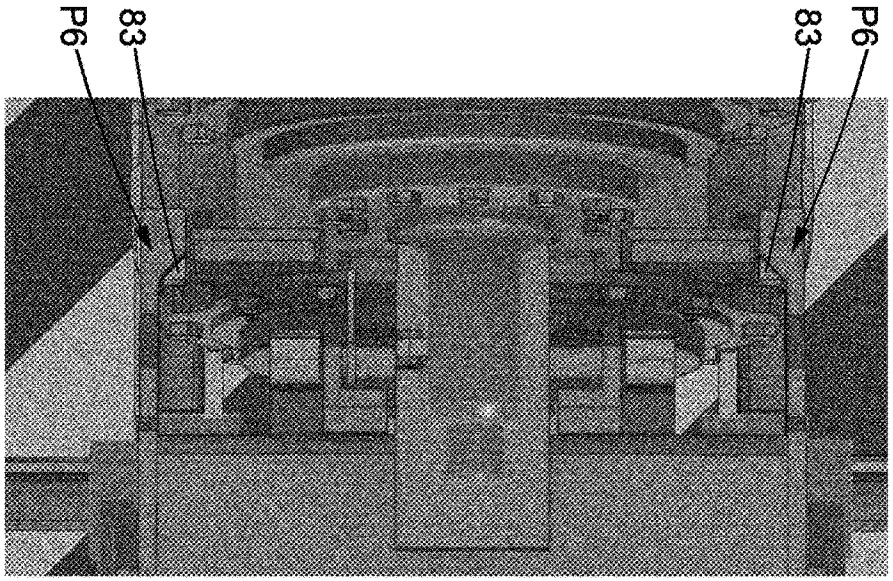
FIG. 33

METHOD FOR CHANGING THE ROLLS ON A ROLLING MILL

CROSS-REFERENCE TO RELATED APPLICATIONS

The contents of the priority application FR 16 53 411 of 18 Apr. 2016 is incorporated herein by reference.

BACKGROUND OF THE INVENTION

Field of the Invention

The invention relates to a method for changing the rolls on a rolling mill for rolling a metal strip, in addition to a rolling mill installation comprising a rolling mill and a roll-changing system advantageously allowing the method of the invention to be carried out.

Description of the Related Art

The field of the invention is that of Quarto stand rolling mills for a specific application, for example in annealing lines, or galvanising lines, or off-line reversing or non-reversing rolling mills, for rolling a metal strip. The rolling mill according to the invention has a specific application, in particular after the annealing of the strip, for performing a skin-pass operation, often in order to eliminate the yield point of the metal strip, to achieve strip roughness and/or to improve the brightness and/or flatness thereof.

A Quarto stand rolling mill has a roll stand comprising two pairs of uprights, at the two ends of the stand between which four rolls with parallel axes are provided, i.e. two work rolls, one lower and one upper, defining the nip through which passes the strip to be rolled, as well as two backup rolls, one upper and one lower, bearing respectively against the work rolls on the opposite side to the side of the passage nip. The drive assembly for driving the rolls is provided on one side of the stand; the other so-called operator side is that on which the maintenance tasks are performed, in particular the roll change operations through the access hatch provided between the two uprights of the stand on the said operator side.

In such rolling mills, each backup roll or work roll is mounted such that it rotates at the ends thereof on chocks, via bearings, for example rolling bearings or hydrostatic bearings. These chocks are supports that can be displaced in a direction parallel to the clamping plane, between the two uprights of the stand.

A Quarto type rolling mill comprises means for applying a clamping force between the chocks of the backup rolls, in the form of two hydraulic cylinders, often at the lower end of the stand, respectively bearing against the two chocks of one of the backup rolls, often of the lower backup roll. When retracted, the said two hydraulic cylinders allow the stand to be opened, i.e. they allow the upper rolls (upper backup roll and upper work roll) to be distanced from the lower rolls (lower backup roll and lower work roll), and to be positioned such that the latter can be extracted from the stand.

The chocks of the work rolls, and the chocks of the backup rolls are thus mounted such that they slide in a direction parallel to the clamping plane, such as to allow the opening of the stand, or the closing thereof, or to ease maintenance and dismantling tasks.

For this purpose, each chock generally comprises two sliding plates, parallel and opposite one another, on either side of the rotational axis of the roll, and engaging with sliding plates secured to the uprights and parallel thereto, at the level of the two lateral sides of the hatch. However, the said sliding plates do not lock the chocks (and the roll thereof) in position along the axis of the roll being supported.

In the field of rolling mills, the said locking of the chocks of the roll in position along the axis of the roll is known as chock "clamping". In a Quarto stand rolling mill, the system for clamping the chocks of the work or backup rolls comprises, generally for each chock, two vertical chock grooves, facing one another and located on either side of the rotational axis of the roll, in addition to two associated locking members, respectively secured to the uprights and capable of moving horizontally. Each locking member can move from a locked position wherein the locking member penetrates the vertical groove, to an unlocked position wherein the locking member is retracted outside of the said groove.

In the locked position, the locking member, which is secured to the upright, prevents the displacement of the chock along the axis of the roll, while allowing the chock to slide along the vertical axis of the uprights, by the displacement of the locking member along the vertical groove of the chock.

In order to allow the work rolls and backup rolls to be changed, the rolling mill must be opened, by retracting the screw-down cylinders, and the clamping system must be unlocked. Only after the said two actions have been performed can the rolls and the chocks thereof be extracted from the stand of the rolling mill.

The backup rolls and the work rolls of the Quarto type rolling mills in the prior art are extracted from the roll stand, through the access hatch on the operator side, by means of two independent, parallel extraction systems superimposed on one another, located on the drive side of the rolling mill, namely:

- a first extraction system comprising an actuator, generally a hydraulic cylinder, the stroke whereof is sufficient to allow the work rolls to be extracted from the roll stand, by a pushing action, and the displacement of the work roll along the longitudinal axis thereof, and
- a second, independent extraction system comprising another actuator, generally another hydraulic cylinder, the stroke whereof allows the backup rolls to be extracted from the roll stand, by a pushing action, and the displacement of the backup roll along the longitudinal axis thereof.

Once extracted from the rolling mill, these two extraction systems then allow new rolls (respectively the work rolls and the backup rolls) to be inserted into the roll stand of the rolling mill.

According to the observations of the Applicant, there is a need, in Quarto stand rolling mills, for a method for changing the rolls of the rolling mill, which would allow the cost of the rolling mill installation to be substantially reduced.

A Quarto stand rolling mill installation is known from document WO03/099479A1 of the prior art, the said installation being equipped with an extraction system which comprises an actuator bearing the reference numeral 7, in this instance a cylinder, that is substantially horizontal, provided with a coupling head comprising two superimposed arms 17a, 17b respectively positioned at the height of the upper work roll 2a and of the lower work roll 2b. Hydraulic (or electric) clamp heads, bearing the reference numeral 18, are associated with the said two arms.

Document WO03/099479A1 further discloses a method for extracting rolls, which ensures the extraction of the work rolls bearing the reference numerals 2a and 2b, as well as the extraction of the backup rolls 3*a*, 3*b* by using, as the sole actuator with a horizontal stroke, the actuator bearing the reference numeral 7, to push the work rolls out of the stand, then to push the backup rolls out of the stand.

The method for extracting the four rolls takes place as follows, and is broken down into two steps: firstly the extraction of the work rolls, then the extraction of the backup rolls. In the open position of the stand of the rolling mill, the two clamp heads (which are hydraulic or electric) firstly allow the two ends of the work rolls bearing the reference numerals 2a and 2b to be simultaneously grasped; the actuator bearing the reference numeral 7 is then used to exert a pushing force in order to simultaneously extract the two work rolls 2a and 2b, which are thus extracted from the stand of the rolling mill, while the backup rolls 3a and 3b remain present inside the stand.

In order to withdraw the backup rolls, support equipment (bearing the reference numeral 11) is used, and is inserted into the stand of the rolling mill, positioned between the upper backup roll and the lower backup roll. Once this support equipment 11 and the upper backup roll 3a are at rest on the lower backup roll 3a, the support equipment 11 is connected to the actuator 7. For this purpose, the upper clamp head of the upper arm (17a engages with a specific portion 19 of the support equipment 11. The stroke of the actuator is then used to withdraw the assembly constituted from the lower backup roll 3b, the support equipment 11 and the lower backup roll, in one movement.

According to the observations of the Applicant, this installation of the prior art has certain drawbacks, and in particular:

- the need to insert the support equipment bearing the reference numeral 11 directly into the interspace between the upper backup roll 3a and the lower backup roll 3b (at this point present in the stand of the rolling mill), which requires handling equipment dedicated to this operation,
- the use of an extraction system that comprises not only an actuator bearing the reference numeral 7, the horizontal stroke whereof is used to push the rolls out of the stand, but also two dedicated actuators (hydraulic or electric clamp heads) for the two arms respectively, and in order to grasp the two ends of the two work rolls, which increases the cost of the installation.

Document US 2002/0078728 discloses a Quarto stand rolling mill and a method for changing the work rolls and backup rolls implemented in such an installation.

The extraction system comprises a single actuator (bearing the reference numeral 54) with a horizontal stroke, provided with a coupling head (bearing the reference numeral 54a), which is used to withdraw the set of rolls (work and backup rolls), and according to a sequence shown in FIG. 6(A) to 6(D).

FIG. 6(A) shows the step of extracting the two work rolls (together) under the pushing action of the actuator 54. Following this extraction, the lower backup roll 53 is raised by cylinders 16, allowing the chock of the lower backup roll 54 to be in contact with the hook 54a of the horizontal actuator 54. The same actuator 54 with a horizontal stroke is then used to withdraw the lower backup roll 53, while the upper backup roll remains present in the stand of the rolling mill.

FIG. 6(B) shows the next step for which support equipment bearing the reference numeral 59 ("roll changing stool") is positioned such that it bears against the chocks of the lower backup roll (at this point located outside of the stand), before the assembly, i.e. the lower backup roll and the support equipment, is inserted into the stand of the rolling mill under the pulling action of the actuator 54, and as shown in FIG. 6(C).

The upper backup roll is thus lowered onto the support equipment 59, bearing thereon via its chocks, the actuator 54 then being used to jointly push the assembly constituted from the lower backup roll, the support equipment and the upper backup roll (superimposed thereon).

Thus, the extraction method implemented in this document of the prior art US 2002/0078728 uses, like document WO 03/099479A1, support equipment ("roll changing stool") similar to the equipment bearing the reference numeral 11 in the prior art document WO03/099479A1, allowing the upper and lower backup rolls to be withdrawn together.

According to the observations of the Applicant, the aforementioned method in this prior art document US 2002/0078728 is advantageous compared to that of document WO03/099479A1 in that the horizontal actuator bearing the reference numeral 54 is used, in addition to the lower backup roll (temporarily extracted) in order to allow the said equipment to be inserted into the stand of the rolling mill, and as shown in FIGS. 6(B) and 6(C), and unlike in document WO 03/099479A1, which requires the insertion of the said support equipment directly between the backup rolls present in the stand of the rolling mill.

According to the observations of the Applicant, the installation of the said prior art document US 2002/0078728 nonetheless has certain drawbacks, and in particular the need to provide support rails inside the stand of the rolling mill for supporting the lower backup roll 53 at varying heights, referred to as "up-and-down rails 15", capable of being actuated in an upwards or downwards direction through the use of cylinders 16.

In the low position of the rails, the hook 54a of the horizontal actuator is aligned with the complementary hook of the chock 57 of the lower work roll, and as shown in FIG. 6(A), allowing the actuator to be in contact with the work rolls to allow for the extraction thereof.

In the high position thereof, the support rails 15 for supporting the lower backup roll are aligned with the rails bearing the reference numeral 18, allowing the lower backup roll to be withdrawn. The raising of the rails from the low position to the high position further allows the hook 54a to come into contact with a complementary hook of the chock of the lower backup roll.

In other words, and in order to extract the set of rolls (i.e. the work rolls and backup rolls), the actuator 54 (having a horizontal stroke) for pushing the rolls must be combined with a rail system, intended to support the chocks of the lower backup roll and the cylinders whereof, bearing the reference numeral 16, allow the height of the lower backup roll to be changed (and thus that of the lower work roll bearing thereagainst) in order to allow the same hook 54a of the horizontal actuator to respectively come into contact with a hook 54b of the chock of the work roll (in the low position of the rails 15 shown in FIG. 6(A), and in contact with a hook 24 of the chock of the lower backup roll (in the high position of the rails shown in FIG. 6(B) to 6(C)).

This invention achieves this purpose by proposing a method for changing the rolls, which can advantageously use an extraction system using a single actuator for extracting all of the rolls of the rolling mill More particularly, this invention proposes such a method having a single actuator, the coupling head whereof can be firstly connected to the chock of a work roll, then secondly to the chock of a backup roll, in order to allow all of the rolls (i.e. the work rolls and the backup rolls) to be extracted together, while reducing the costs of the installation generated by these operations, and in comparison with the prior art disclosed by the document US 2002/0078728.

Another purpose of this invention is to propose such a rolling mill installation comprising a rolling mill, in addition to a system for extracting rolls, at a lesser cost relative to the installations of the prior art, in particular suitable for implementing the method.

BRIEF SUMMARY OF THE INVENTION

Other advantages of the invention will appear when reading the following description, which is given for the purpose of illustration only and is not intended to limit the scope of the invention.

The invention firstly relates to a method for changing the rolls on a rolling mill for rolling a metal strip, which is carried out in an installation having:

- a rolling mill comprising:
  - a roll stand,
  - a set of superimposed rolls having substantially parallel axes, comprising two work rolls, one lower and one upper, defining the nip through which the strip passes, and two backup rolls, respectively one lower and one upper, intended to bear respectively against the work rolls on the opposite side to the side of the nip,
  - each roll having two ends mounted such that they rotate, each of which on a bearing supported by a chock,
  - guide means between the chocks of the rolls and the roll stand along the clamping plane,
  - means for applying a clamping force between the chocks of the backup rolls, comprising hydraulic cylinders,
  - a system for clamping the chocks of the rolls, locking the chocks in position relative to the roll stand, along the axis of the roll, while allowing the chocks to slide along the guide means, along the clamping plane,
  - means for driving the backup rolls, on one side of the roll stand of the rolling mill,
- a system for extracting the work rolls and the backup rolls provided, on the drive side of the said rolling mill and comprising:
  - an actuator configured to push the rolls out of the roll stand of the rolling mill when the rolls are being extracted, or conversely to pull the rolls into the roll stand when the rolls are being inserted,
  - a coupling head secured to the said actuator, situated in an open position of the roll stand at an intermediate height between the lower work roll and the lower backup roll, capable of moving in a direction parallel to the rolls, from a first retracted position wherein the coupling head is located on the drive side, to a second deployed position wherein the coupling head, having passed through the roll stand, is located on the operator side, the said coupling head comprising:
    - first coupling means configured to drive the chock or the end of the lower work roll, on the drive side of the rolling mill,
    - second coupling means configured to drive the chock of the lower backup roll, on the drive side of the rolling mill, having a retracted state wherein they do not drive the chock of the lower backup roll and a deployed state wherein they drive, by a pushing action, the chock of the said lower backup roll,
  - and wherein the chocks of the upper and lower work rolls have connection means, on the operator side, creating a mechanical connection between the said chocks on the operator side,
  - and wherein the work rolls and the backup rolls are extracted, after opening the roll stand of the said rolling mill, during which step the lower work roll and the lower backup roll are distanced from the upper work roll and from the upper backup roll, when the metal strip is present along the through feed plane of the said rolling mill by implementing the following successive steps:
    - a first extraction step wherein the upper work roll and the lower work roll are extracted, by a pushing action from the said actuator on the chock of the lower work roll, on the drive side, the coupling head passing from the first retracted position to the second deployed position, the said upper work roll being driven together with the lower work roll via the mechanical connection created, on the operator side, between the chocks of the lower and upper work rolls, the said second coupling means of the coupling head being in the said retracted state, in which they do not drive the chocks of the backup rolls during the said pushing action,
    - a return step wherein the coupling head is brought back from the second deployed position towards the drive side into the first retracted position,
    - a second extraction step wherein the lower backup roll is extracted from the roll stand by a pushing action from the said actuator on the chock of the lower backup roll on the drive side, the coupling head passing from the first retracted position to the second deployed position, the said second coupling means being in the said deployed state driving the pushing of the chock of the said lower backup roll,
    - a positioning step wherein support equipment is positioned on the lower backup roll, the bottom portion whereof bears against the chocks of the lower backup roll, and the top portion whereof is intended to be used to support the chocks of the upper backup roll, the said support equipment being capable of being inserted into the roll stand,
    - an insertion step wherein the lower backup roll and the said support equipment are inserted into the roll stand, by the pulling force exerted by the return of the coupling head towards the drive side, from the second deployed position into the first retracted position, the said support equipment having a clearance through which passes the metal strip when inserted into the roll stand,
    - a depositing step wherein the upper backup roll is deposited on the top portion of the support equipment, by an action of lowering the said upper backup roll,
    - a third extraction step wherein the group constituted from the lower backup roll, the support equipment and the said upper backup roll is extracted by a pushing action from the said actuator on the chock of the lower backup roll, on the drive side.

According to one noteworthy feature of the invention, the second coupling means are passed from the retracted state wherein they do not drive the chock of the lower backup roll to the deployed state wherein they drive the pushing of the chock of the said lower backup roll by manual action on the said second coupling means, subsequently to the said first extraction step, the coupling head being in the said second deployed position, accessible on the operator side of the said rolling mill, and prior to the said return step.

Moreover, and according to the invention, the coupling head can be coupled to the work roll (and when the second coupling means are in the retracted state and are not driving the lower backup roll) in order to allow for the implementation of the first step for extracting the work rolls, and then can be coupled to the lower backup roll for implementing the subsequent steps, whereby the said change is made manually, in other words without the use of an actuator (such as the cylinders bearing the reference numeral 16 in the prior art document US 2002/0078728) for making the said change in coupling.

In the invention, the change in coupling of the coupling head (from the retracted state of the second coupling means to the deployed state) is achieved by manual action by an operator (and thus without the use of an electric, hydraulic, pneumatic or other actuator that would increase the cost of the installation).

For example, and according to one embodiment, the second coupling means comprise at least one movable element, articulated on the chassis of the coupling head, suitable for engaging, by a pushing action, with the chock of the lower backup roll which, on the one hand, in the retraced state of the second coupling means, is raised and locked in a retracted position wherein the said movable element does not engage with the chock of the lower backup roll, on the drive side, and which on the other hand, in the deployed state of the second coupling means, is in a deployed position wherein the said movable element projects downwards under the effect of gravity, and wherein the said movable element is configured in the said deployed position in order to engage with a protruding portion on the top surface of the chock of the lower backup roll on the drive side, and wherein:

during the said coupling head return step, the said passage of the coupling head from the second deployed position to the first retracted position causes the engagement of the protruding portion against the movable element, which pivots about the articulation thereof under the effect of the protruding portion, in order to escape from the said protruding portion, before returning, under the effect of gravity, to the position wherein the said movable element projects downwards, on the other side of the protruding portion, during the second extraction step, the said movable element abuts against the said protruding portion, on the other side of the protruding portion, under the effect of the pushing action from the actuator and such that it allows the said lower backup roll to be withdrawn.

According to one embodiment of the method:

the roll stand of the rolling mill comprises support rails on which rest the chocks of the upper and lower work rolls, in the open position of the roll stand, the said support rails being used to guide the work rolls and the chock thereof during the extraction of the rolls inside the said roll stand, the said rolling mill installation comprises a support car having support rails suitable for supporting and guiding the chocks of the lower and upper work rolls which, in a position of the car relative to the rolling mill, extend the support rails of the rolling mill, and such that the lower and upper work rolls are loaded onto the support car when the coupling head reaches the said second deployed position during the first extraction step.

According to the optional characteristics of the method, which can be implemented alone or in any combination thereof:

the first coupling means comprise a hook rigidly secured to the coupling head intended to engage with a corresponding hook secured to the end, on the drive side, of the lower work roll, and suitable for exerting a pushing force on the lower work roll during the first extraction step and the passage of the coupling head from the first retracted position to the second deployed position, and for exerting a pulling force on the work roll during the passage of the coupling head from the second deployed position to the first retracted position;

the clamping and unclamping between, on the one hand, the hook of the first coupling means of the coupling head, and on the other hand, the corresponding hook of the lower work roll, take place under the movements of the car, in a direction perpendicular to the support rails;

According to one embodiment, the second coupling means comprise at least one folding element suitable for engaging under a pulling force with the chock of the lower backup roll, which in the said deployed position of the said folding element, allows for the abutment with the chock, on the drive side, of the lower backup roll in order to exert a pulling force, allowing the lower backup roll and the support equipment to be inserted during the said insertion step, in the folded position of the said folding element, allows, subsequently to the said third extraction step, the uncoupling of the coupling head from the said lower backup roll extracted from the roll stand, during the return movement of the coupling head from the second deployed position to the first retracted position.

The invention further relates to a rolling mill installation having:

a rolling mill comprising:

a roll stand, a set of superimposed rolls having substantially parallel axes, comprising two work rolls, one lower and one upper, defining the nip through which the strip passes, and two backup rolls, respectively one lower and one upper, intended to bear respectively against the work rolls on the opposite side to the side of the nip, each roll having two ends mounted such that they rotate, each of which on a bearing supported by a chock, guide means between the chocks of the rolls and the roll stand along the clamping plane, means for applying a clamping force between the chocks of the backup rolls, comprising hydraulic cylinders, a system for clamping the chocks of the rolls, locking the chocks in position relative to the roll stand, along the axis of the roll, while allowing the chocks to slide along the guide means, along the clamping plane, means for driving the backup rolls, on one side of the roll stand of the rolling mill, a system for extracting the work rolls and the backup rolls situated on the drive side of the said rolling mill, comprising:

an actuator configured to push the rolls out of the roll stand of the rolling mill when the rolls are being extracted, or conversely to pull the rolls into the roll stand when the rolls are being inserted, a coupling head secured to the said actuator, situated in an open position of the roll stand at an intermediate height between the lower work roll and the lower backup roll, capable of moving in a direction parallel to the rolls, from a first retracted position wherein the coupling head is located on the drive side, to a second deployed position wherein the coupling head, having passed through the roll stand, is located on the operator side, the said coupling head comprising:

first coupling means configured to drive the chock or the end of the lower work roll, on the drive means side of the rolling mill, second coupling means configured to drive the chock of the lower backup roll, on the drive side of the rolling mill, having a retracted state wherein they do not drive the chock of the lower backup roll and a deployed state wherein they drive, by a pushing action, the chock of the said lower backup roll, and wherein the chocks of the upper and lower work rolls have connection means, on the operator side, opposite the drive means, creating a mechanical connection between the said chocks on the operator side, and wherein the first coupling means and the second coupling means of the said extraction system are configured in such a way as to allow:

successive extractions of the work rolls and then of the backup rolls from the roll stand, successive insertions of the backup rolls and then of the work rolls into the roll stand.

According to the invention, the second coupling means comprise at least one movable element, articulated on the chassis of the coupling head, suitable for engaging under a pushing force with the chock of the lower backup roll, which:

in the retracted state of the second coupling means, the said at least one movable element is raised and locked in a retracted position wherein the said movable element does not engage with the chock, of the lower backup roll, on the drive side of the rolling mill, in the deployed state of the second coupling means, is in a deployed position wherein the said movable element projects downwards under the effect of gravity.

Advantageously, the said movable member is a member with manual actuation for passing from the retracted position to the deployed position of the said movable member, or conversely, the said movable element being configured in the said deployed position such that it engages with a protruding portion on the top surface of the chock of the lower backup roll, on the drive side, present in the roll stand, and such that:

the said passage of the coupling head from the second deployed position to the first retracted position causes the engagement of the protruding portion against the movable element, which pivots about the articulation thereof under the effect of the protruding portion, in order to escape from the said protruding portion, before returning, under the effect of gravity, to the position wherein the said movable element projects downwards, on the other side of the protruding portion;

the said movable element, thus in position on the other side of the protruding portion, abuts against the said protruding portion under the effect of the pushing action from the actuator and such that it allows the said lower backup roll to be withdrawn.

According to one embodiment:

the roll stand of the rolling mill comprises support rails on which rest the chocks of the upper and lower work rolls, in the open position of the roll stand, the said support rails being used to guide the work rolls and the chock thereof during the extraction of the rolls inside the said roll stand, the said rolling mill installation comprising a support car having support rails suitable for supporting and guiding the chocks of the lower and upper work rolls which, in a position of the car relative to the rolling mill, extend the support rails of the rolling mill, and such that the lower and upper work rolls are loaded onto the car when the pushing force is exerted by the actuator on the work rolls.

According to the optional characteristics of the installation, which can be implemented alone or in any combination thereof:

the first coupling means comprise a hook rigidly secured to the coupling head intended to engage with a corresponding hook secured to one of the ends of the lower work roll, and suitable for exerting a pushing force on the lower work roll when the coupling head is pushed from the first retracted position to the second deployed position, and for exerting a pulling force on the lower work roll during the passage of the coupling head from the second deployed position to the first retracted position;

the clamping and unclamping between, on the one hand, the hook of the first coupling means of the coupling head, and on the other hand, the corresponding hook of the lower work roll, take place under the movements of the car, in a direction perpendicular to the support rails.

According to one embodiment, the second coupling means comprise at least one folding element suitable for engaging under a pulling force with the chock of the lower backup roll on the drive side, which in the said deployed position of the said folding element, allows for the abutment with the chock, on the drive side, of the lower backup roll in order to exert a pulling force, allowing the lower backup roll to be inserted into the stand of the rolling mill, in the folded position of the said folding element, allows for the uncoupling of the coupling head from the said lower backup roll extracted from the roll stand, during the return movement of the coupling head from the second deployed position to the first retracted position.

According to one advantageous embodiment, the said folding element is a member that is manually actuated for the passing from the deployed position to the folded position of the said folding member, or vice-versa.

According to one embodiment, whereby the chocks on the operator side of the work rolls have parallel sliding plates distributed on either side of the axis of the roll, intended to engage with sliding plates secured to two uprights on the operator side of the rolling mill, the connection means comprise at least one tab, the proximal end whereof is secured to one of the lower or upper chocks, received in a lateral groove, made in the body of the chock, at the back of a sliding plate, and the distal end whereof penetrates a groove of the other chock, at least in a deployed position of the said tab, in the said open position of the roll stand.

BRIEF DESCRIPTION OF THE DRAWINGS

The invention will be better understood upon reading the following description, given with reference to the accompanying figures, in which:

FIG. 32 is a detailed view of the coupling head, more particularly showing the folding elements in the folded position thereof, subsequent to a manual action performed on the operator side, allowing the coupling head to be uncoupled from the said lower backup roll during the return movement of the coupling head towards the drive side, FIG. 33 is a view successive to that of FIG. 32 showing the step of uncoupling the coupling head from the said lower backup roll.

DETAILED DESCRIPTION OF THE PREFERRED EMBODIMENTS

Figure 1:
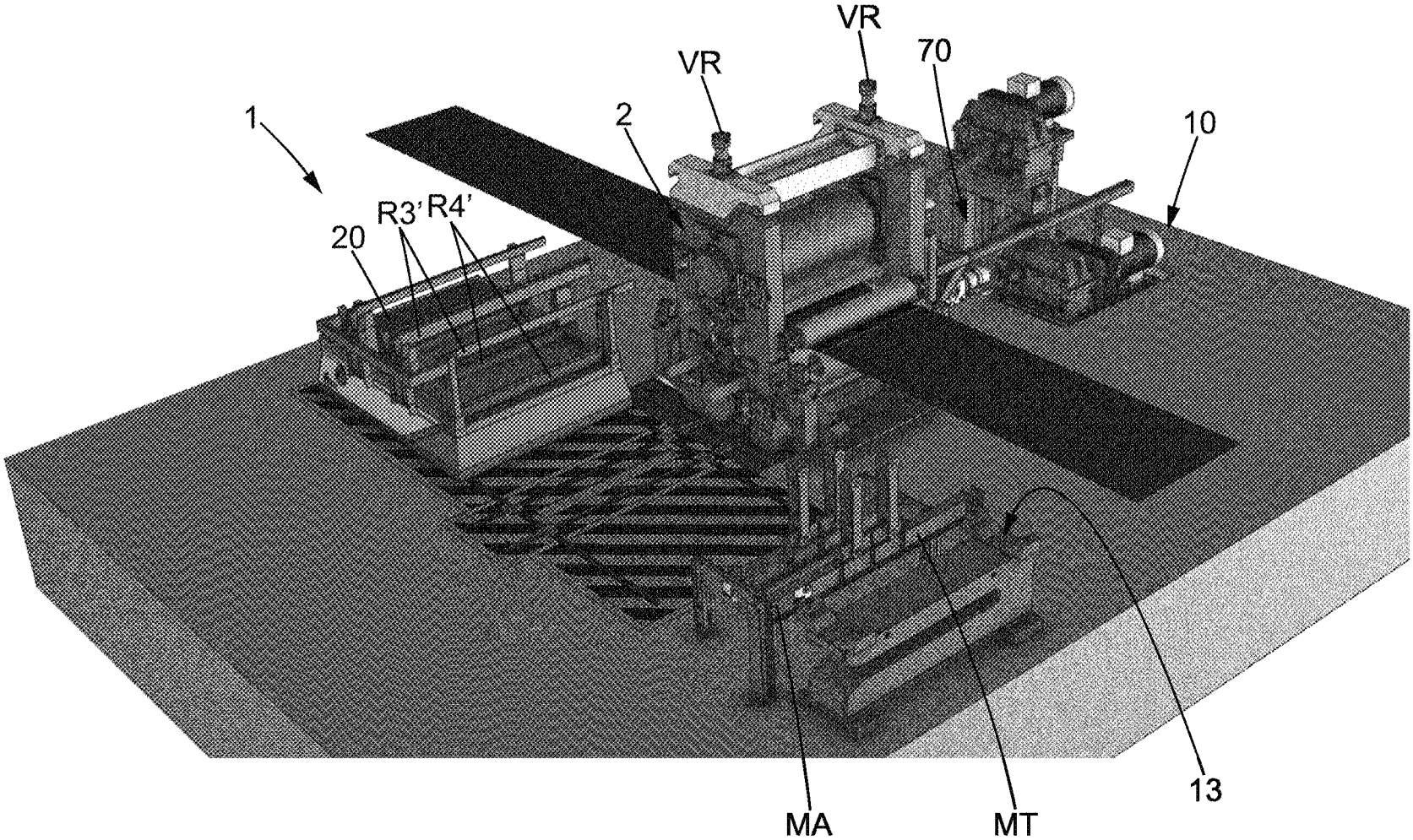
FIG. 1 is a perspective overview showing the Quarto type rolling mill, including the roll stand, in which are present the backup and work rolls, the system for driving the backup rolls of the rolling mill, and the single-actuator extraction system, of the rack and pinion type, situated on the drive side of the rolling mill, the perspective view further showing, on the operator side of the roll stand (opposite that of the drive system), the support car for supporting the work rolls, U-shaped support equipment (removable), capable of being inserted into the roll stand, intended to withdraw the two backup rolls together, as well as handling members intended for lifting the backup and work rolls, or the said support equipment.
Figure 2:
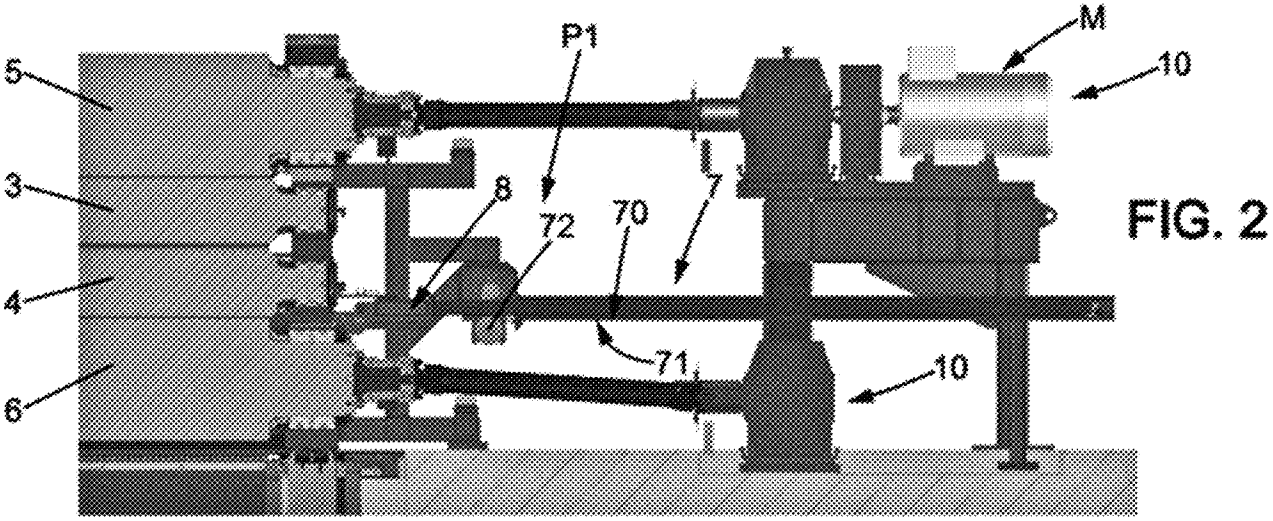
FIG. 2 is a sectional view along a plane passing through the clamping plane of the rolling mill, more particularly showing the extraction system, in the said first retracted position of the coupling head.

Thus, the invention relates to a rolling mill 1, in particular of the Quarto type, for rolling a metal strip comprising a roll stand 2, comprising two pairs of uprights, at the two ends of the stand between which a set of superimposed rolls are provided, the said rolls having substantially parallel axes, comprising two work rolls 3, 4, one lower and one upper, defining the nip through which passes the strip, and two backup rolls 5, 6, one upper and one lower respectively, intended to bear respectively against the work rolls on the opposite side to the side of the passage nip.

Each work roll or backup roll has two ends, generally referred to as roll necks, mounted such that they rotate, each on a bearing supported by a chock 30, 40, 50, 60.

The rolling mill further comprises guide means between the chocks 30, 40, 50, 60 of the rolls and the roll stand 2 along the clamping plane. The said guide means can comprise sliding surfaces between the chocks and the frame (in particular the uprights) of the roll stand 2.

For example:

each chock 30 of the upper work roll 3 has two sliding plates 31, parallel to and opposite one another, distributed on either side of the rotational axis of the work roll 3, engaging with two sliding plates 27, respectively rigidly secured to the uprights of the same pair at one end of the roll stand, each chock 40 of the lower work roll 4 has two sliding plates 41, parallel to and opposite one another, distributed on either side of the rotational axis of the work roll 4, engaging with the sliding plates 27, respectively rigidly secured to the uprights of the same pair at one end of the roll stand.

For example, the two sliding plates 27 are respectively secured on the inner walls of two bending cylinder units Vc3, Vc4, themselves respectively secured, via the outer wall thereof, to the two inner walls of the uprights of the same pair of uprights of the stand.

Similarly:

each chock 50 of the upper backup roll 5 can have two sliding plates 51, parallel to and opposite one another, distributed on either side of the rotational axis of the backup roll 5, engaging with sliding plates 25, rigidly secured to the uprights of the same pair at one end of the roll stand, and each chock 60 of the lower backup roll 6 can have two sliding plates 61, parallel to and opposite one another, distributed on either side of the rotational axis of the backup roll 6, engaging with sliding plates 26, rigidly secured to the uprights of the same pair at one end of the roll stand.

The rolling mill further comprises means for applying a clamping force between the chocks of the backup rolls, generally comprising hydraulic cylinders $V_S$. The said hydraulic cylinders $V_S$, two of which are present, can be arranged in the lower portion of the roll stand and can respectively bear against the two chocks 60 of the lower backup roll 6. According to one embodiment, not shown, the said hydraulic cylinders $V_S$ can also be provided in the upper portion of the roll stand 2 and can respectively bear against the chocks of the upper backup roll.

The rolling mill further comprises a clamping system for clamping the chocks 30, 40 of the work rolls 3 and 4, and a clamping system 9 for clamping the chocks 50, 60 of the backup rolls 5, 6.

The clamping system for clamping the work rolls shown in the examples is that disclosed by the Applicant of the French patent application FR 1652265 of 17 Mar. 2016, which allows the chocks of the work rolls to be locked, or conversely allows the work rolls to be axially displaced under the opening and closing actions of the roll stand. The description of this system for clamping the work rolls is not explicitly repeated herein. However, one of ordinary skill in the art can refer to the said document for the execution thereof. Within the scope of this application, other systems for clamping the work rolls can be considered, and in particular a system with dedicated cylinders disclosed in the prior art in the patent application FR 1652265.

The clamping system 9 for clamping the chocks of the backup rolls for passing from a retracted state, allowing the backup rolls to be withdrawn, along the axis thereof, from the roll stand, to a locking state locking the chocks in position relative to the stand, along the axis of the roll, while allowing the chocks to slide along the guide means, along the clamping plane.

The said clamping system 9 can comprise vertical grooves in the chocks 50, 60 of the upper backup roll 5 and of the lower backup roll 6, as well as locking members 90, mounted such that they slide horizontally. Each locking member can pass from a position wherein it penetrates the vertical groove of the chocks 50 or 60, preventing the axial displacement of the backup roll, to a retracted position wherein axial displacement is made possible. Given the frequency of maintenance operations for the backup rolls, the clamping system can be manual, whereby the passage from the retracted position to the locking position is manual and obtained by actuating a handle 91.

The rolling mill further comprises drive means 10 for driving the backup rolls, on one side of the roll stand of the rolling mill, referred to as the drive side hereinbelow.

In a conventional manner for one of ordinary skill in the art, an electric motor M is used to drive the lower and upper backup rolls via a transmission connecting the motor output to the ends of the backup rolls, on the drive side.

The invention disclosed here more particularly concerns the system for extracting work rolls and backup rolls, and which is situated on the drive side of the said rolling mill.

The said extraction system allows, as will be described hereafter, the extraction of worn rolls from the roll stand of the rolling mill, in particular with a view to the re-turning thereof, as well as the insertion of freshly turned (or new) rolls into the roll stand.

For this purpose, the extraction system comprises:

an actuator 70 configured to push the rolls out of the roll stand 2 of the rolling mill when the rolls are being extracted, or conversely to pull the rolls into the roll stand 2 when the rolls are being inserted, a coupling head 8 secured to the said actuator 70, situated in an open position of the roll stand 2 at an intermediate height between the lower work roll 4 and the lower backup roll 6, capable of moving in a direction parallel to the rolls 3, 4, 5, 6.

The actuator can comprise a motorised rack 71 and pinion 72 pair, whereby the chassis of the coupling head 8 is rigidly secured to the distal end of the rack 71. The rotation of the pinion 72 in a first direction allows for the translational movement of the rack along the axis thereof, as well as for the translational movement of the coupling head 8.

The coupling head 8 is capable of moving from a first retracted position P1 wherein the coupling head is located on the drive side, to a second deployed position P2 wherein the coupling head 8, having passed through the roll stand 2, is located on the operator side and accessible to operators.

Moreover, said coupling head 8 comprises first coupling means configured to drive the chock 40 or the end of the lower work roll 4, on the drive side of the rolling mill, second coupling means configured to drive the chock 60 of the lower backup roll 6, on the drive side of the rolling mill: the second coupling means having a retracted state wherein they do not drive the chock of the lower backup roll 6 and a deployed state wherein they drive, by a pushing action, the chock 60 of the said lower backup roll 6.

In a noteworthy manner, the chocks 30, 40 of the upper and lower work rolls have connection means 11, on the operator side, opposite the drive means, creating a mechanical connection 12 between the said chocks on the operator side.

The said mechanical connection 12 ensures the joint withdrawal of the two work rolls 3, 4 when the actuator 70 of the extraction system solely exerts a pushing force (on the drive side) on the lower work roll, and as explained hereafter.

Figure 10:
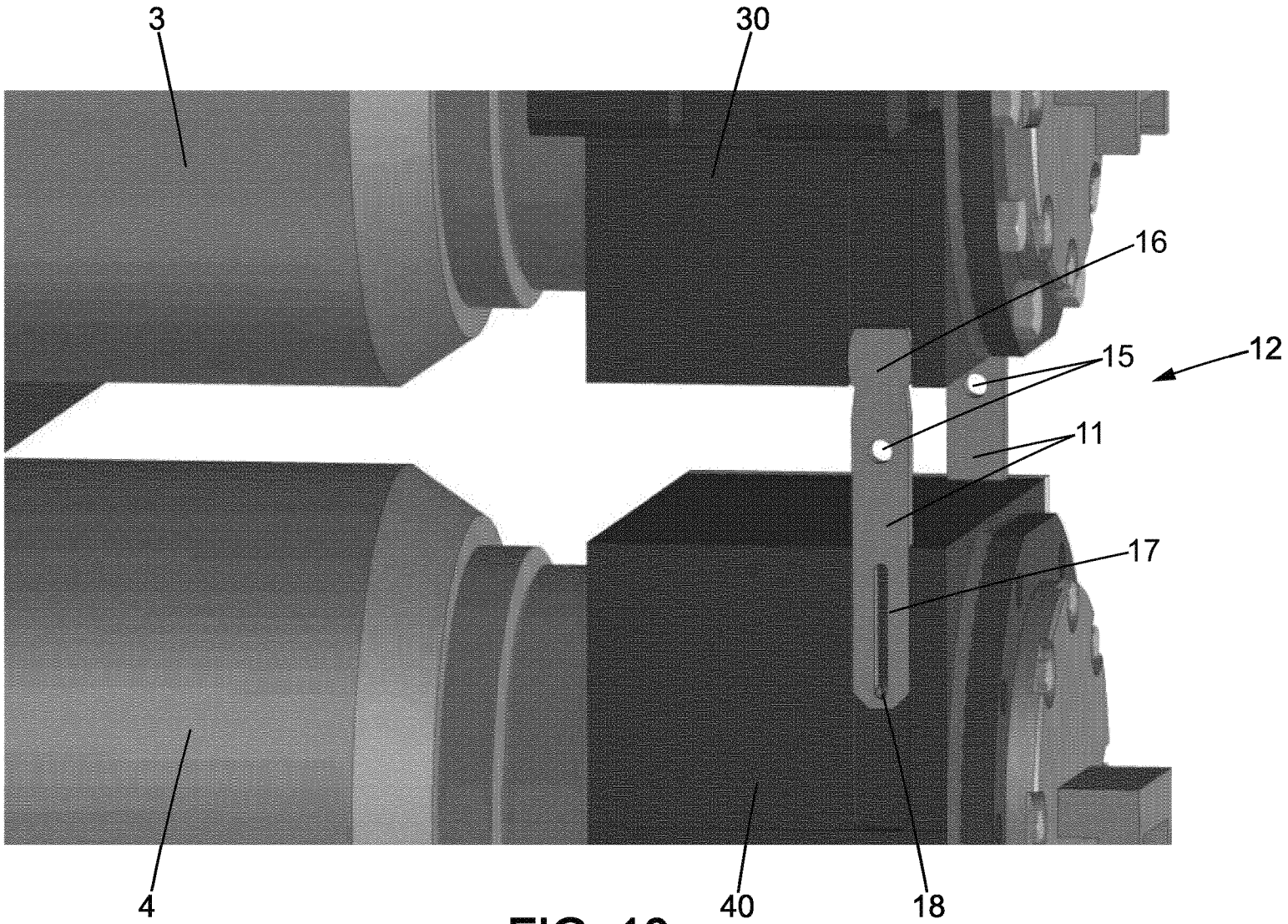
FIG. 10 is a detailed view of the chocks (on the operator side) of the work rolls, and more particularly of the members allowing for the creation of a mechanical connection for withdrawing the two work rolls together when the actuator of the extraction system solely exerts a pushing force (on the drive side) on the lower work roll.

For example, and as shown in FIG. 10, whereby the chocks on the operator side of the work rolls have the said parallel sliding plates 31, 41 (not shown) distributed on either side of the axis of the roll, intended to engage with the sliding plates 27 secured to two uprights on the operator side of the rolling mill, the connection means 11 can comprise at least one tab 15 (or two tabs 15), the proximal end whereof is secured to a marked chock of either the lower or upper chocks, received in a lateral groove, made in the body of the chock, at the back of a sliding plate 31 or 41, and the distal end 16 whereof penetrates a groove of the other chock, at the back of the sliding plate, at least in a deployed position of the said tab, in the said open position of the roll stand.

It should be noted that the (or each) tab 15 is substantially parallel to the sliding plates 31 or 41, whereby the distal end 16 of the tab can have a rounded contour so as to allow for a slight pivoting of the distal end in the groove, which will in particular occur during the bending action on the work rolls.

The tab 15 can furthermore be provided such that it retracts into a retracted position inside the chock 30 (position not shown), the chock 30 having means for locking said tab 15 in the deployed position. The said means can comprise a ball and spring system. An oblong aperture 17 in the tab through which a stud 18 is intended to pass, the said stud being secured to the chock, can also be provided in order to prevent dismantling of the tab.

Advantageously, the first coupling means and the second coupling means of the said extraction system are configured in such a way as to allow:

successive extractions of the work rolls and then of the backup rolls from the roll stand.

successive insertions of the backup rolls and then of the work rolls into the roll stand.

In other words, the invention advantageously allows:

all rolls of the rolling mill to be extracted (i.e. work rolls then backup rolls) by means of a single actuator, as opposed to the prior art known by the Applicant, all rolls of the rolling mill to be inserted (i.e. backup rolls then work rolls) by means of a single actuator, as opposed to the prior art known by the Applicant.

As shall be understood from the following description, the extraction system allows for the possibility of extracting the work rolls only, then of inserting new work rolls (new or freshly turned rolls) into said roll stand (whereby the backup rolls remain in the roll stand).

The description hereafter will describe the method for changing the rolls implemented in such a rolling mill installation, and more particularly the different steps implemented in order to extract the set of work rolls and backup rolls using the single-actuator extraction system. These different steps are shown in detail in FIGS. 6 to 33.

One of ordinary skill in the art understands that the steps of the method allowing the backup rolls, then the work rolls to be inserted are essentially the same, but performed by reversing the order of the steps allowing for the rolls to be extracted.

Moreover, the work rolls 3, 4 and the backup rolls 5, 6 are extracted, after opening the roll stand of the said rolling mill, during which step the lower work roll 4 and the lower backup roll 6 are distanced from the upper work roll 4 and from the upper backup roll 5, when the metal strip B is present along the through feed plane of the said rolling mill.

Figure 6:
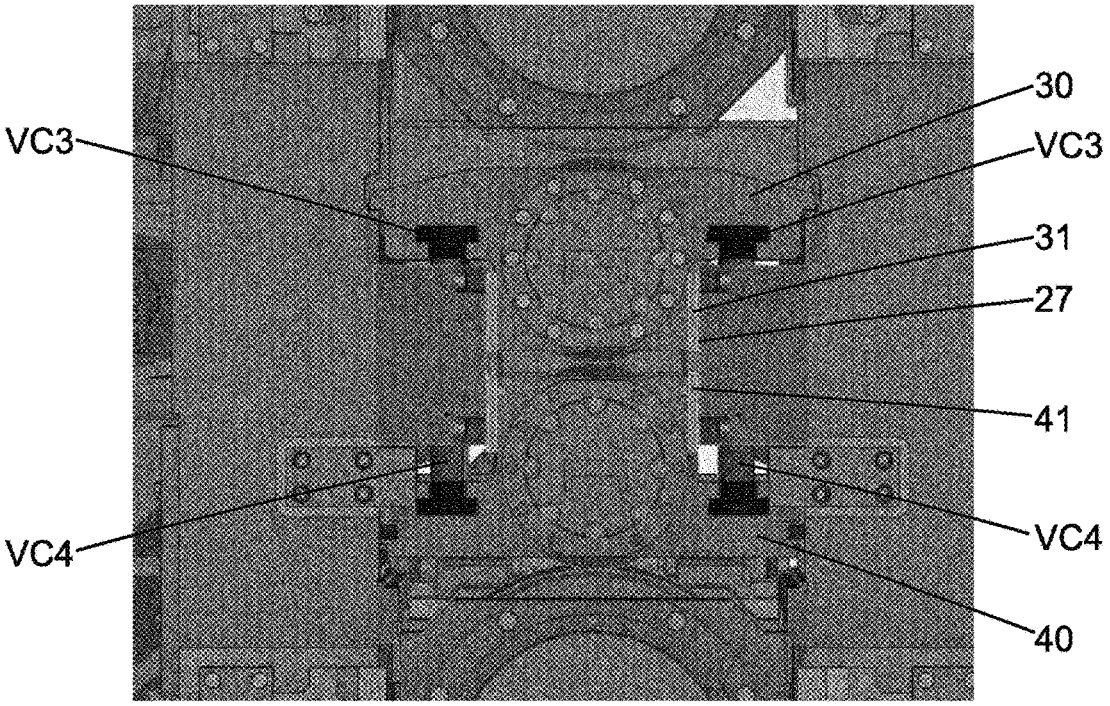
FIGS. 6 and 7 are views of the work and backup rolls, respectively in the closed and open position of the roll stand.
Figure 7:
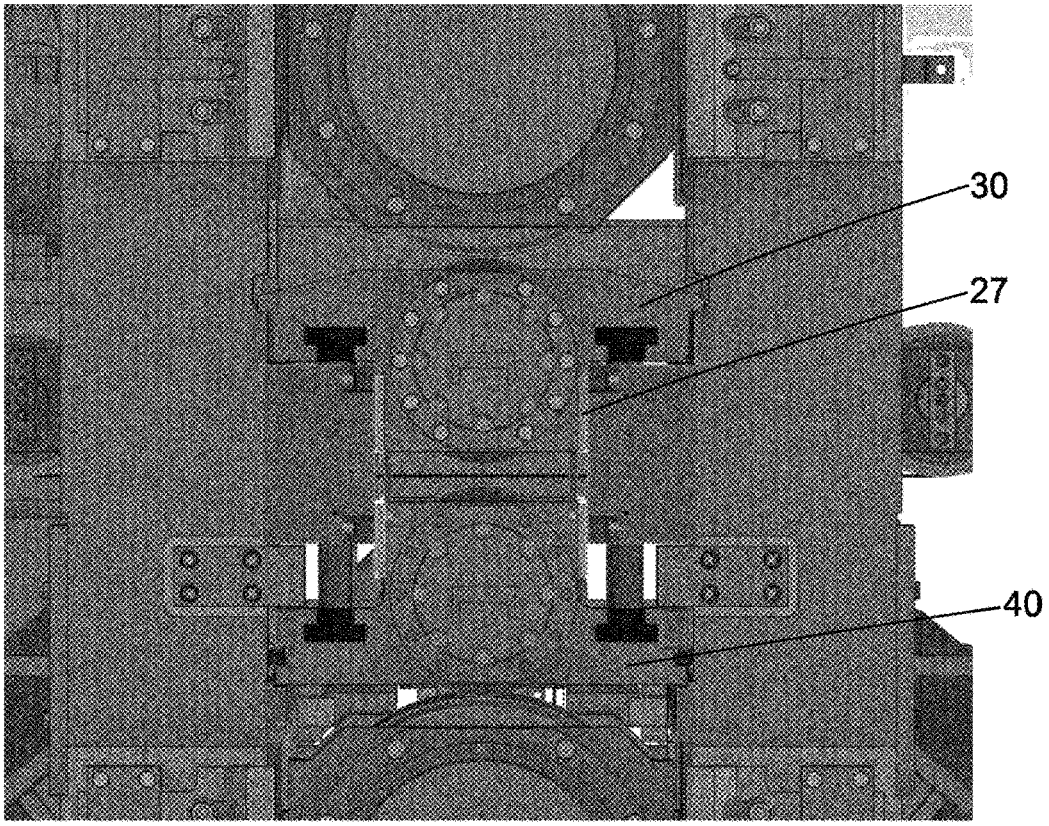

This step of opening the rolling mill stand is shown in FIGS. 6 and 7, caused by the retraction of the hydraulic cylinders $V_S$. If necessary, and according to one embodiment, said opening automatically results in the unclamping of the chocks 30, 40 of the work rolls 3, 4.

Moreover, the work rolls 3, 4 and the backup rolls 5, 6 are extracted by implementing the following successive steps:

a first extraction step E1 (see FIGS. 11 to 13) wherein the upper work roll 3 and the lower work roll 4 are extracted, by a pushing action from the said actuator 70 on the chock 40 of the lower work roll 4, on the drive side, the coupling head 8 passing from the first retracted position P1 to the second deployed position P2, the said upper work roll 3 being driven together with the lower work roll 4 via the mechanical connection 12 created, on the operator side, between the chocks 30, 40 of the lower and upper work rolls, the said second coupling means of the coupling head 8 being in the said retracted state, in which they do not drive the chocks of the backup rolls during the said pushing action, a return step E2 (see FIGS. 19 to 24) wherein the coupling head 8 is brought back from the second deployed position P2 towards the drive side into the first retracted position P1, a second extraction step E3 (see FIGS. 24 and 25) wherein the lower backup roll 6 is extracted from the roll stand 2 by a pushing action from the said actuator on the chock 60 of the lower backup roll 6 on the drive side, the coupling head 8 passing from the first retracted position P1 to the deployed position P2, the said second coupling means being in the said deployed state driving the pushing of the chock 60 of the said lower backup roll 6, a positioning step E4 (see FIGS. 26 and 27) wherein support equipment 13 is positioned on the lower backup roll 6, the bottom portion whereof bears against the chocks 60 of the lower backup roll 6, and the top portion whereof is intended to be used to support the chocks 50 of the upper backup roll, the said support equipment 13 being capable of being inserted into the roll stand 2, an insertion step E5 (see FIG. 28) wherein the lower backup roll 6 and the said support equipment 13 are inserted into the roll stand 2, by the pulling force exerted by the return of the coupling head 8 towards the drive side, from the deployed position P2 into the retracted position P1, the said support equipment 13 having a clearance 14 through which passes the metal strip B when inserted into the roll stand 2, a depositing step E6 (see FIGS. 29 and 30) wherein the upper backup roll 5 is deposited on the top portion of the support equipment 13, by an action of lowering the said upper backup roll 5, a third extraction step E7 (see FIG. 31) wherein the group constituted from the lower backup roll 6, the support equipment 13 and the said upper backup roll 5 is extracted by a pushing action from the said actuator 70 on the chock 60 of the lower backup roll 6, on the drive side.

The roll stand 2 of the rolling mill generally comprises support rails R3, R4 on which rest the chocks 30, 40 of the upper and lower work rolls 3, 4, in the open position of the roll stand 2, the said support rails R3, R4 being used to guide the work rolls 3, 4 and the chock 30, 40 thereof during the extraction of the work rolls from the said roll stand or during the insertion of the work rolls into the roll stand.

The roll stand further comprises support rails R6 on which the chocks 60 of the said lower backup roll 6 are at rest in the open position of the roll stand 2, whereby the chocks 60 have rollers 63 intended to roll along the rails R6, and whereby other rails extend from the rails R6 at the level of the extraction area on the operator side.

The rolling mill installation can comprise a support car 20 comprising support rails R3', R4' suitable for supporting and guiding the chocks 30, 40 of the lower and upper work rolls 3, 4 which, in a position of the car relative to the rolling mill, extend the support rails R3, R4 of the rolling mill, and such that the lower and upper work rolls are loaded together onto the car 20 when the pushing force is exerted by the actuator on the work rolls 3, 4 or conversely are unloaded from the car in order to be inserted into the roll stand during the insertion of the rolls.

Figure 8:
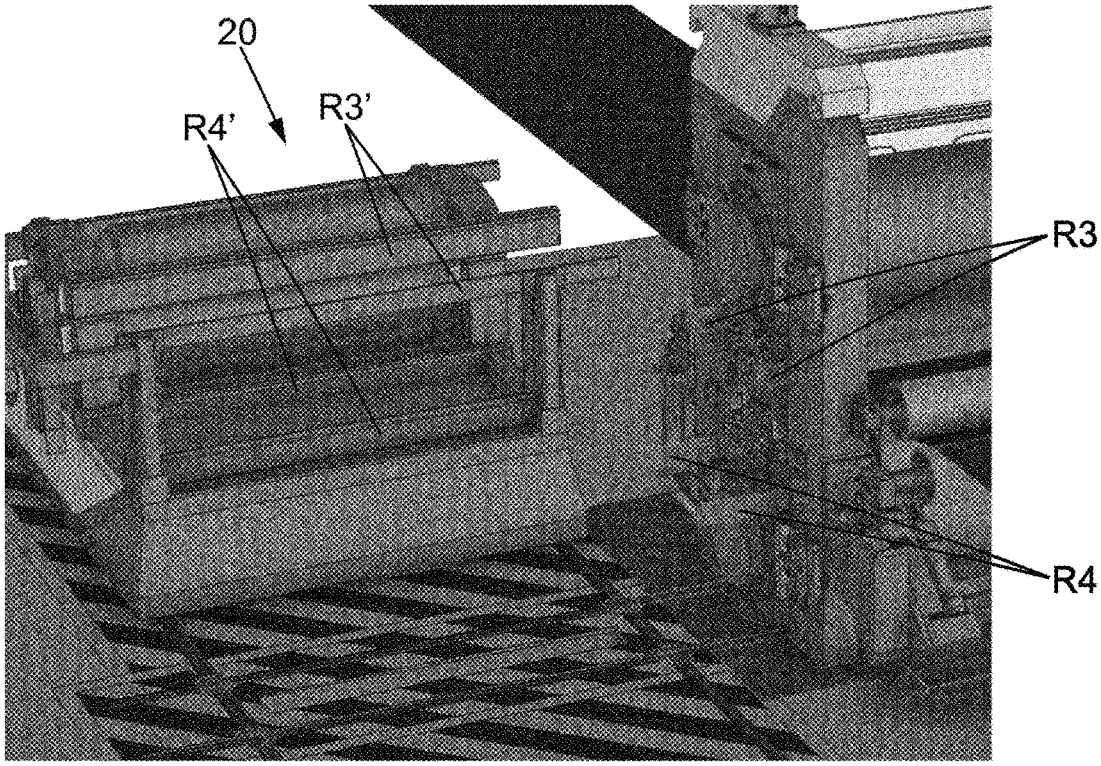
FIGS. 8 and 9 are partial views of the rolling mill installation, on the operator side, showing the support car for the work rolls, respectively in a retracted position of the extraction area, and in a position of the car allowing the work rolls to be received during the extraction thereof.
Figure 9:
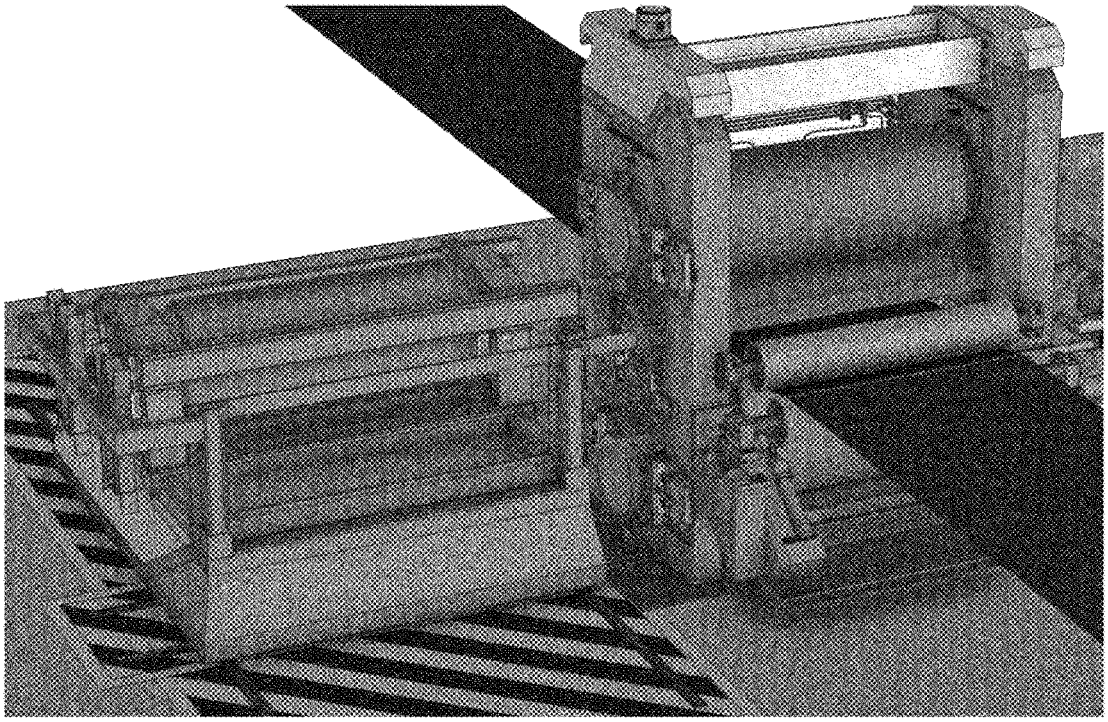

The said support car 20 is capable of moving along rails perpendicular to the support rails, in order to allow the car to be laterally retracted into a position outside of the extraction area, and as shown in FIG. 8.

A handling chassis $M_T$ is used to withdraw the work rolls 3, 4 from above, thanks to a travelling crane in the workshop.

The said car 20 is maintained in the said retracted position outside of the extraction area, in particular during steps wherein the backup rolls are inserted or withdrawn.

As shown in the figures, the car can have four parallel pairs of support rails, so as to be able to support two pairs of upper and lower work rolls side by side.

If only the work rolls 3, 4 are to be changed, a pair of upper and lower work rolls can thus be withdrawn together onto the support car 20 and another pair of work rolls (new or freshly turned rolls) can be immediately loaded, after being previously positioned on the support car, just after a short lateral displacement of the car so as to align the support rails R3' and R4' of the said new rolls with those R3 and R4 of the roll stand 2.

The first coupling means can substantially comprise a hook 81 rigidly connected to the coupling head 8, intended to engage with a corresponding hook 42 secured to the end, on the drive side, of the lower work roll 4, and suitable for:

exerting a pushing force on the lower work roll 4 during the action of pushing the coupling head 8 from the first retracted position P1 to the second deployed position P2, exerting a pulling force on the lower work roll 4 during the passage of the coupling head 8 from the second deployed position P2 to the first retracted position P1.

Figure 3:
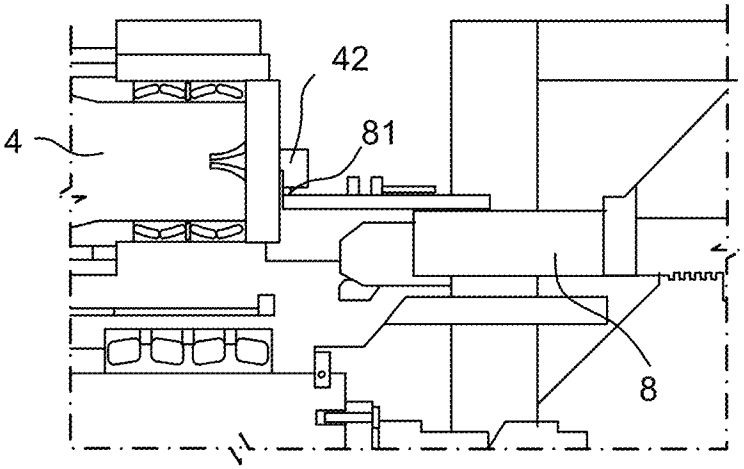
FIG. 3 is a detailed view of FIG. 2 more particularly showing the hook of the first coupling means of the coupling head, in contact with a corresponding hook secured to the end (on the drive side) of the lower work roll, in the first retracted position of the coupling head.
Figure 5:
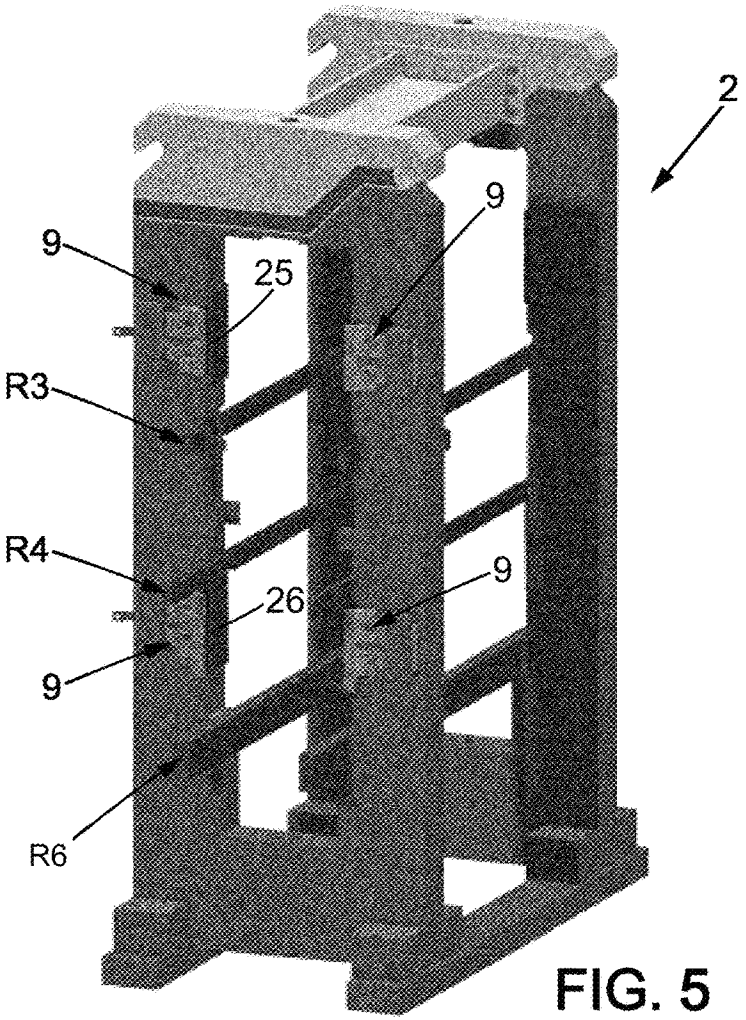
FIG. 5 is an exposed view of the roll stand of the rolling mill.
Figure 4:
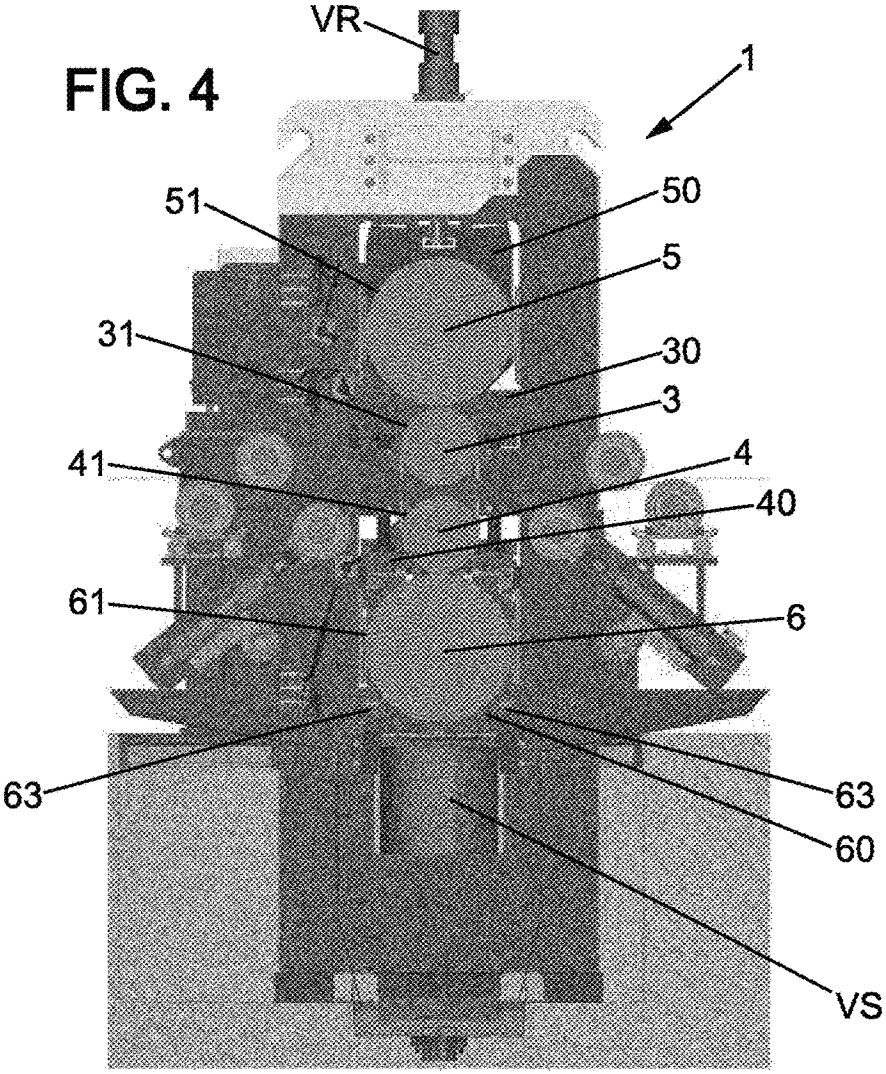
FIG. 4 is a sectional view of the rolling mill, along a vertical plane perpendicular to the rolls.
Figure 11:
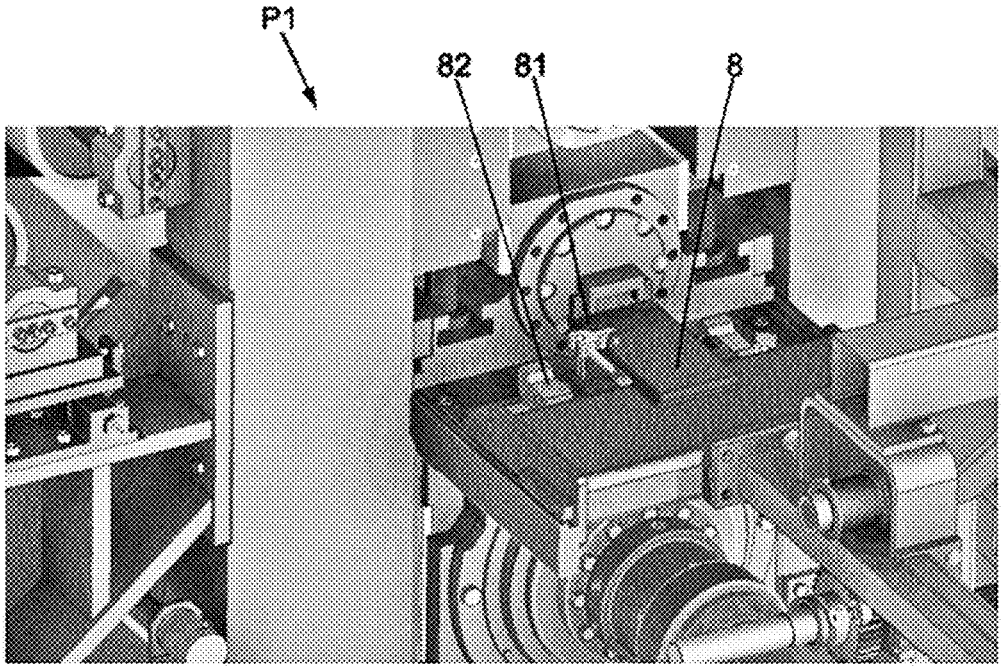
FIG. 11 is a view, on the drive side of the rolling mill, in the first retracted position of the coupling head, the said first coupling means thus being in contact with the end of the lower backup roll, the said second coupling means in the retracted state wherein they are not pushing the lower backup roll.

The said hook 81 is initially in contact with the corresponding hook 42 at the end of the lower work roll, in the said first retracted position P1 of the coupling head, and as shown in FIG. 3 or 11.

Advantageously, the two mutually engaging hooks 81 and 82 are configured such that the clamping and unclamping between, on the one hand, the hook 81 of the first coupling means of the coupling head 8, and on the other hand, the corresponding hook 42 of the lower work roll 4, take place under the movements of the car 20, in a direction perpendicular to the support rails R3', R4'.

The coupling (or uncoupling) of the coupling head 8 with the lower work roll 4 is thus automatic thanks to the motorised displacement of the support car, and does not require a dedicated actuator.

Figure 12:
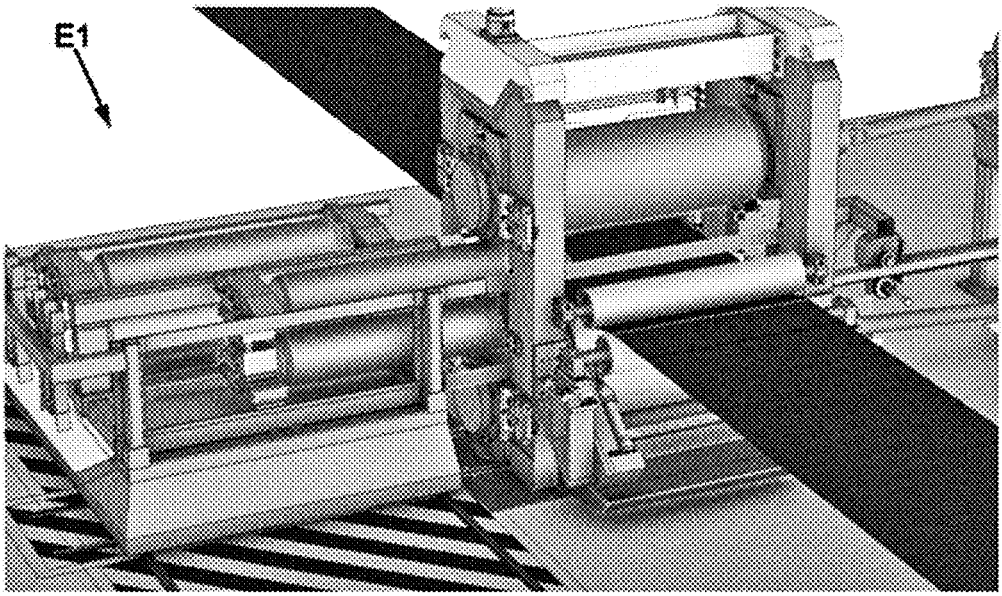
FIG. 12 is a view successive to that of FIG. 11, showing the first extraction step wherein the actuator drives the coupling head by a pushing action, thus in contact with the lower work roll, thus causing the lower work roll to be extracted together with the upper work roll thanks to the mechanical connection shown in FIG. 10, whereby the upper and lower work rolls are thus loaded on the support rails of the support car, and whereby the backup rolls, which are not driven, remain inside the roll stand.
Figure 13:
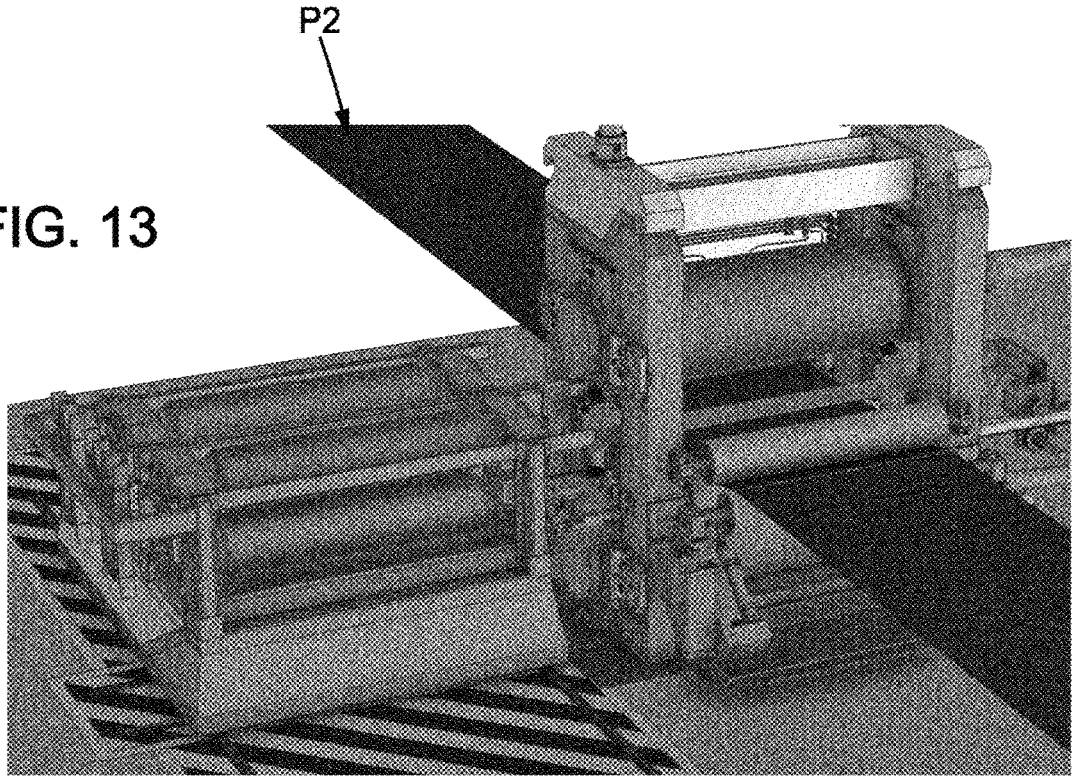
FIG. 13 is a view consecutive to that of FIG. 12, whereby the upper and lower work rolls are thus extracted from the roll stand and entirely supported by the car when the said coupling head is in the second deployed position thereof.

As shown in FIGS. 12 and 13, the support rails R3' and R4' of the support car are aligned with the support rails R3 and R4 during the first extraction step E1.

Figure 14:
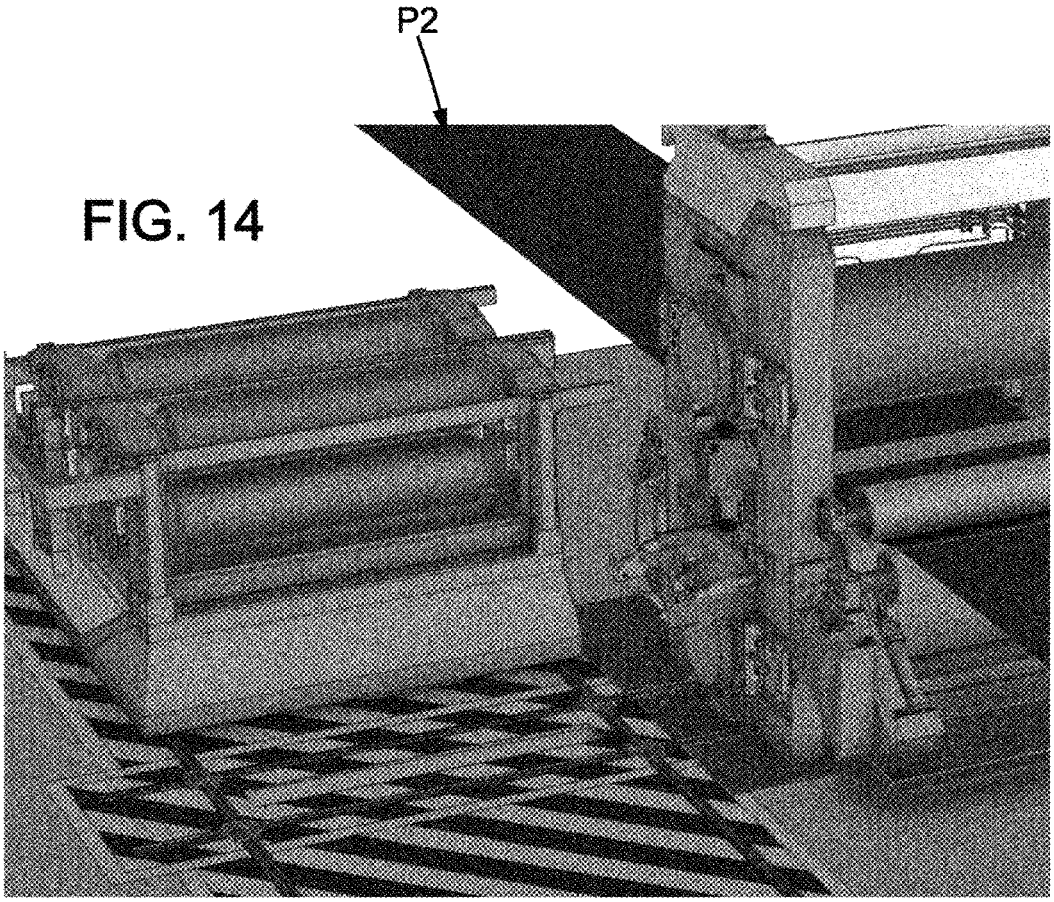
FIG. 14 is a view consecutive to that of FIG. 13, wherein the support car is displaced laterally, freeing the extraction area, on the operator side of the roll stand.

At the end of the extraction step, the car 20 is retracted in a position outside of the extraction area, on the operator side, and as shown in FIG. 14, whereas the coupling head is in the second deployed position P2, accessible from the operator side.

This access to the coupling head 8 advantageously allows, according to the invention, an operator to pass the second coupling means from the retracted state wherein they are not driving the chock of the lower backup roll, to the deployed state wherein they are pushing the chock of the said lower backup roll under a manual action by the operator on said second coupling means. This manual action is successive to the said first extraction step, performed while the coupling head is in the said second deployed position and accessible from the operator side of the said rolling mill, and prior to the said coupling head return step.

Figure 15:
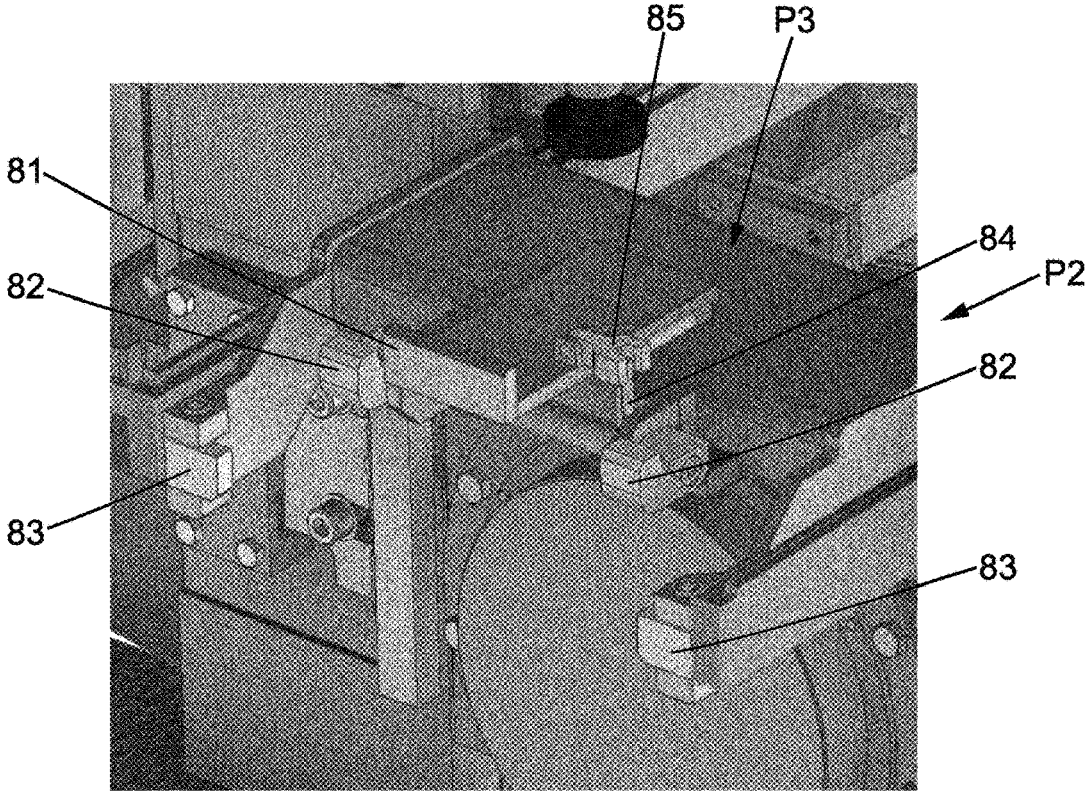
FIGS. 15 and 16 are respectively two views of the coupling head thus located, on the operator side, in the said second deployed position, the said movable element articulated on the chassis of the coupling head along a horizontal pivot axis, being manually shifted from a retracted position shown in FIG. 15 for which the said movable element is not capable of interacting with the chock of the lower backup roll, to a deployed position, shown in FIG. 16, allowing abutment with the chock (on the drive side) of the lower backup roll, during the return of the coupling head towards the drive side.
Figure 16:
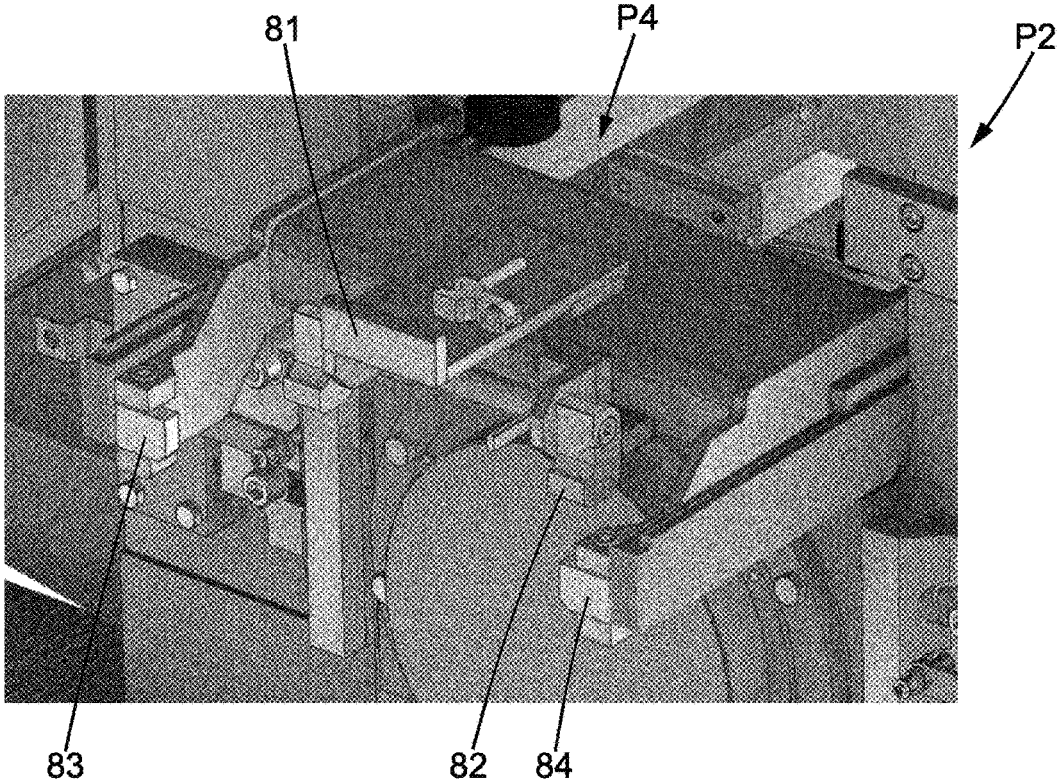
Figure 17:
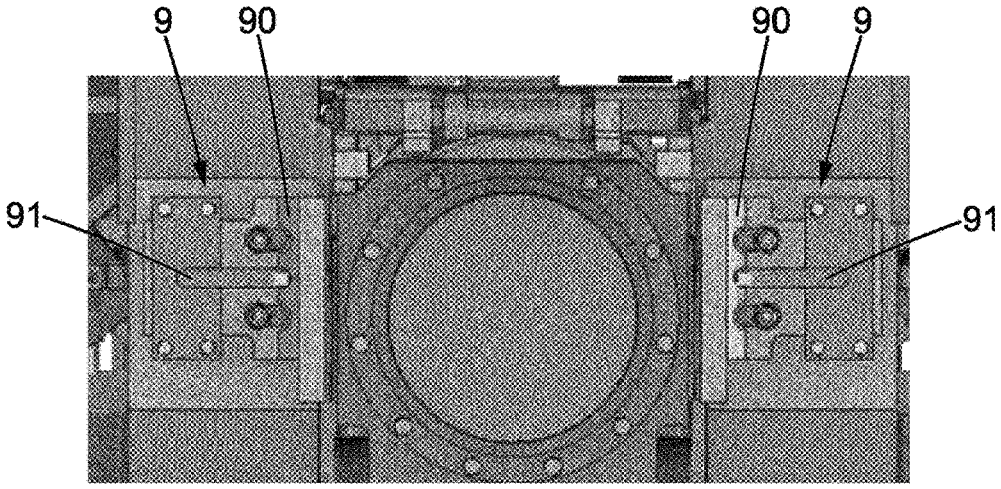
FIGS. 17 and 18 are two detailed views showing the passage of the backup roll chock clamping system from a locked chock position to an unlocked position, making the axial displacement of the backup rolls possible.
Figure 18:
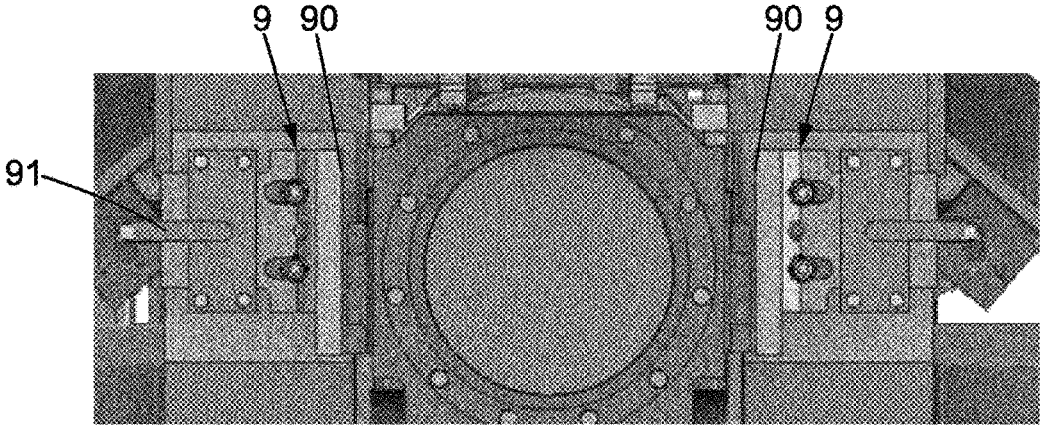
Figure 19:
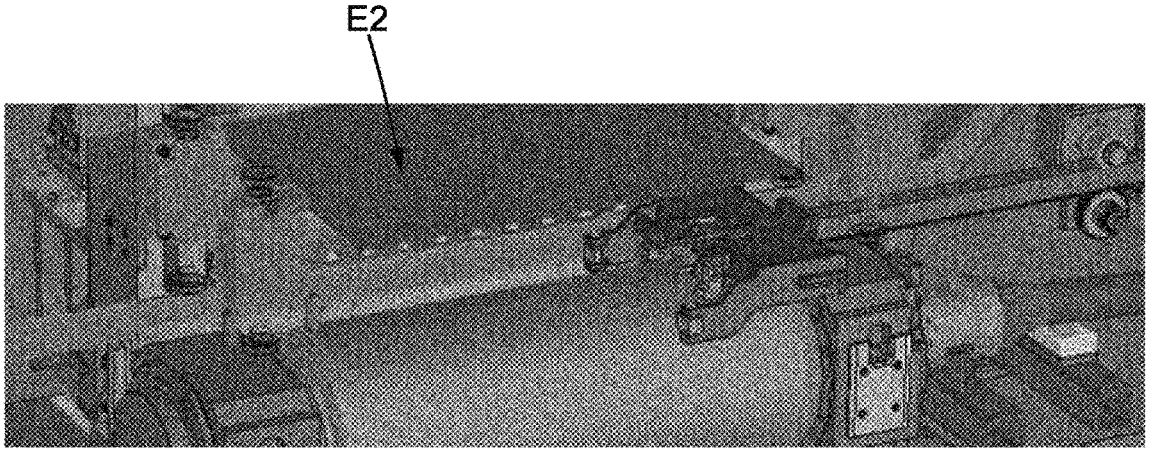
FIG. 19 is a view showing the step of returning the coupling head to the first retracted position.
Figure 20:
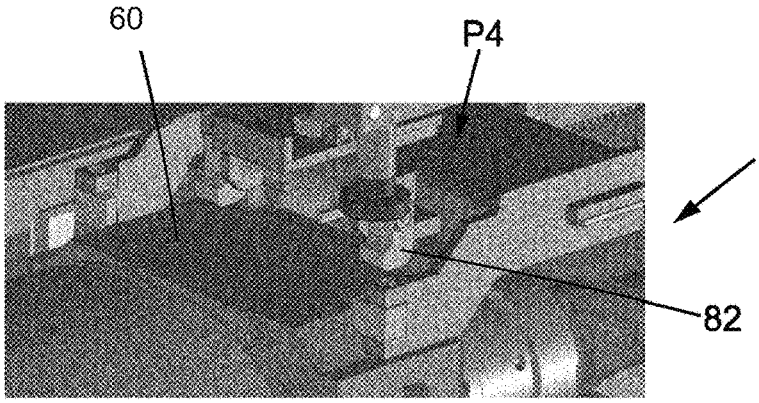
FIGS. 20 to 23 are respectively successive, detailed views of the return of the coupling head from the second deployed position to the first retracted position, whereby the figures respectively show the engagement of a protruding portion on the top surface of the chock against the movable element, freely articulated, which, during the return of the coupling head, pivots about its articulation under the effect of the protruding portion in order to escape the said protruding portion, before returning, under the effect of gravity, to the position wherein the said movable element projects downwards, on the other side of the protruding portion of the chock, in the said first position of the coupling head.
Figure 21:
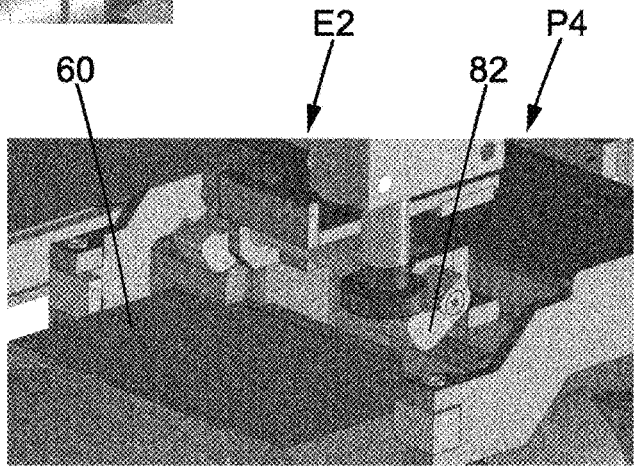
Figure 22:
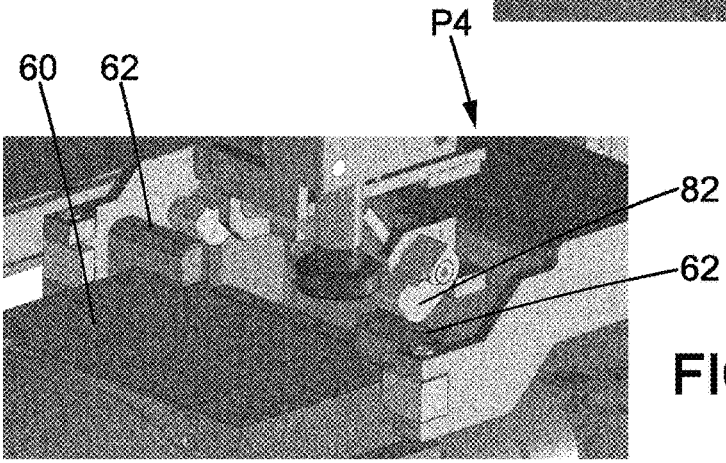
Figure 23:
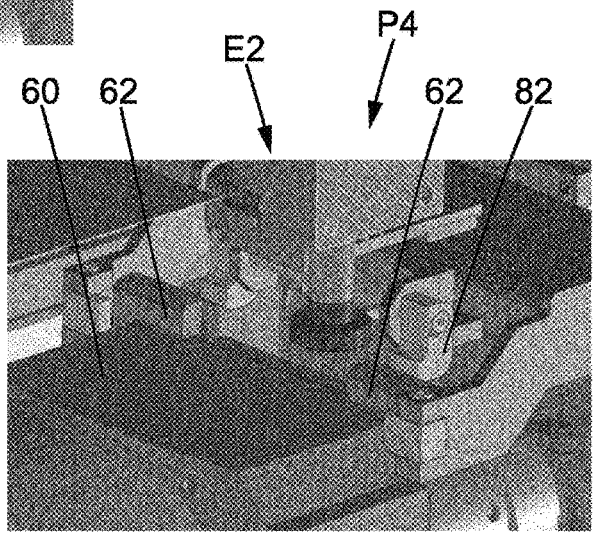

For this purpose, the second coupling means can comprise at least one movable element 82, articulated on the chassis of the coupling head, suitable for engaging under a pushing force with the chock 60 of the lower backup roll 6.

in the retracted state of the second coupling means, the said at least one movable element 82 is raised and locked in a retracted position P3, shown by way of example in FIG. 15, wherein the said movable element 82 does not engage with the chock 60, of the lower backup roll 6, on the drive side of the rolling mill, in the deployed state of the second coupling means, the said at least one movable element 82 is in a deployed position P4, shown by way of example in FIG. 16, wherein the said movable element 82 projects downwards under the effect of gravity.

The passage from the retracted position P3 to the deployed position is thus made possible by a manual action from the operator, when the coupling head 8 is accessible from the operator side. In the retracted position, the movable member 82 can be locked in position by any suitable means and, for example, by means of a yoke 85, articulated on the chassis, which, in one position, allows the movable member 82 to be maintained in a raised position by engagement with a prong 84 rigidly secured to the movable member. Unlocking takes place by moving the yoke 85 about the pivot thereof, the said displacement causing the movable member to be released, which pivots the head downwards, for example half a turn under the effect of gravity.

The said movable element 82 is configured in the said deployed position P4 in order to engage with a protruding portion 62 on the top surface of the chock 60 of the lower backup roll 6 on the drive side, present in the roll stand.

As shown in FIGS. 20 to 23, the said passage of the coupling head 8 from the second deployed position P2 to the first retracted position P1 causes the engagement of the protruding portion 62 against the movable element 82, which pivots about the articulation thereof under the effect of the protruding portion 62 (see FIGS. 20 to 22), in order to escape from the said protruding portion 62, before returning, under the effect of gravity, to the position (see FIG. 23) wherein the said movable element 82 projects downwards, on the other side of the protruding portion 62. In other words, during the return of the coupling head, the said movable element 82 is configured so as to escape a protruding portion 62 on the top surface of the chock 60 of the lower backup roll 6, thanks to the possible rotation of the said at least one movable element (in the clockwise direction in FIGS. 21 and 22).

Figure 24:
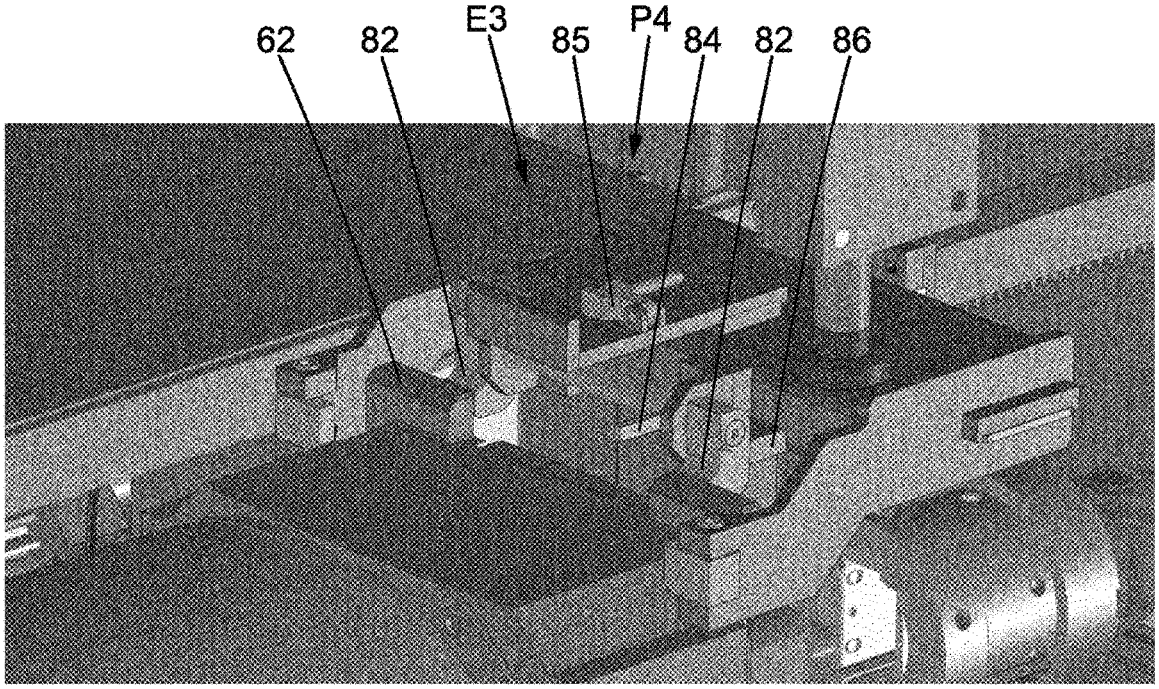
FIG. 24 is a view consecutive to that of FIG. 23, showing the second extraction step wherein the lower backup roll is extracted under the pushing action of the coupling head, thanks to the movable member of the second coupling means which abuts against the protruding portion of the chock on the drive side.

As shown in FIG. 24, the said movable element 82, thus in position on the other side of the protruding portion 62, abuts against the said protruding portion 62 under the effect of the pushing action from the actuator 70 and such that it allows the said lower backup roll 6 to be withdrawn during the second extraction step E3. During the extraction E3, it should be noted that the possibility of rotating the said movable element 82 (in the anti-clockwise direction) is prevented by a stop 86, which allows the said movable element 82 to convey the pushing force required to extract the lower backup roll 6 to the chock 60.

Of course, prior to the extraction of the backup rolls, the axial displacement of the rolls must be made possible by unlocking the clamping system 9 for clamping the backup rolls.

The second coupling means can comprise, as shown in the figures, two substantially parallel movable elements 82 rigidly secured, via the same rotating shaft, to the chassis of the head. The rotating shaft is substantially horizontal and perpendicular to the axis of the lower backup roll. The two movable elements are intended to respectively engage with two protruding portions on the top surface of the chock 60 of the lower backup roll 6.

Figure 25:
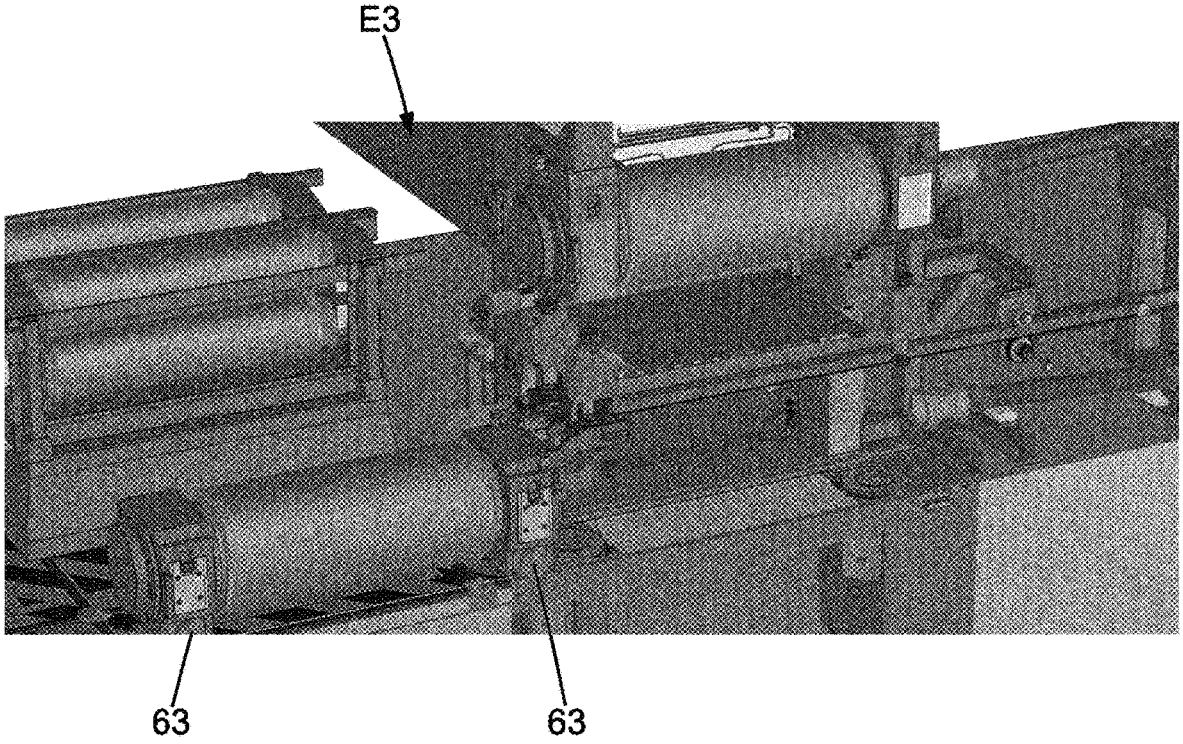
FIG. 25 is a view consecutive to that of FIG. 24, wherein the backup roll is fully extracted in the said second deployed position of the coupling head.
Figure 26:
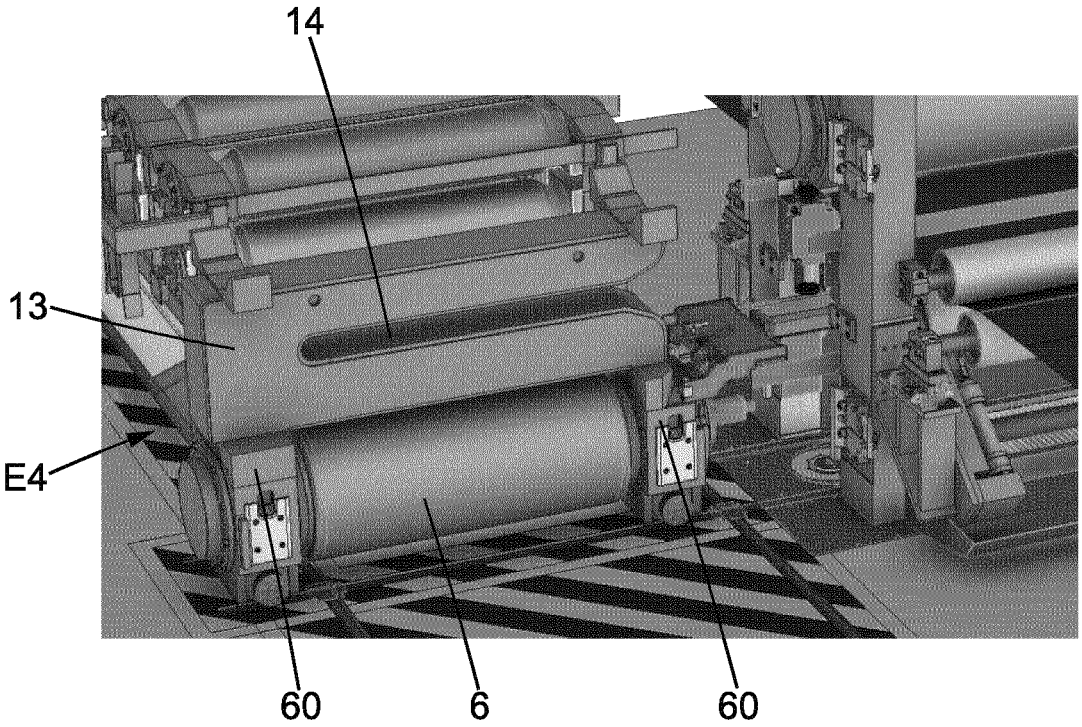
FIG. 26 is a view consecutive to that of FIG. 25 showing the positioning of a support element, capable of being inserted into the roll stand, the bottom portion whereof is at rest on the chocks of the lower backup roll, and the top portion whereof is provided such that it supports the chocks of the upper backup roll.
Figure 27:
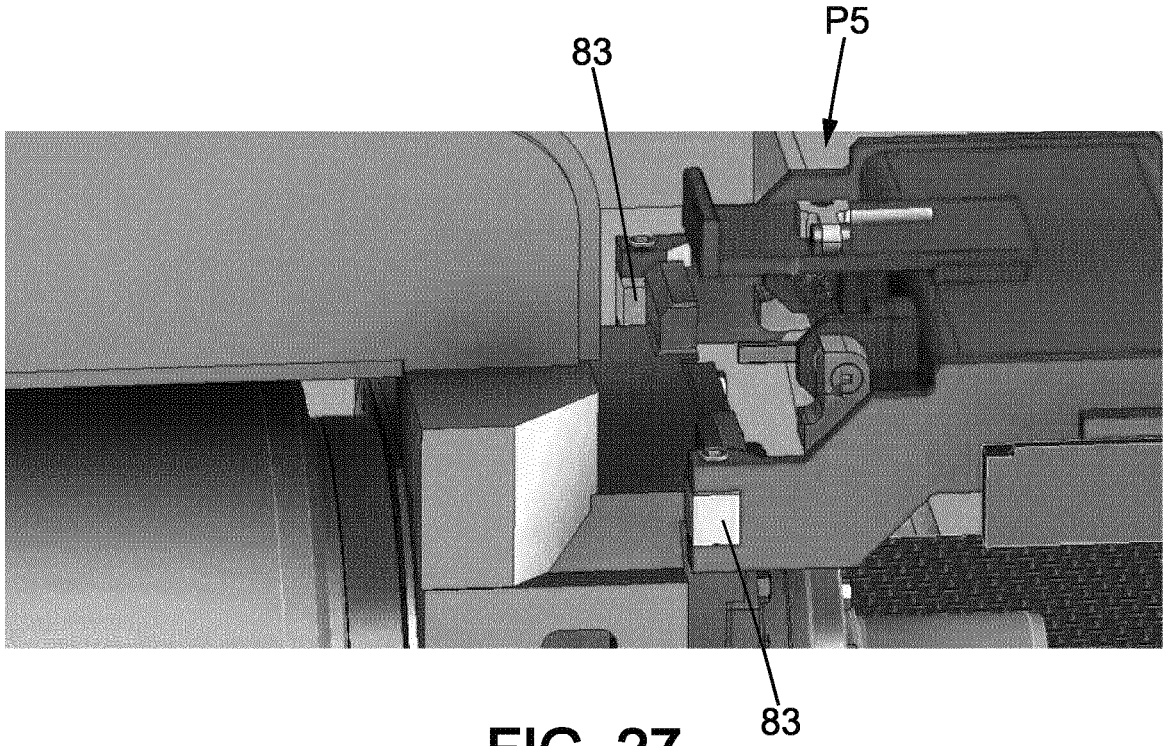
FIG. 27 is a detailed view of the coupling head, more particularly showing two folding elements in the deployed position thereof, allowing abutment with the chock (on the drive side) of the lower backup roll in order to exert a pulling force, and thus allow for the insertion of the lower backup roll into the stand of the rolling mill.

At the end of the second extraction step E3, the lower backup roll 6 is extracted from the roll stand 2, and as shown by way of example in FIG. 25. The next step is the said positioning step E4, wherein support equipment 13 is positioned on the lower backup roll 6 by means of a handling appliance (i.e. a travelling crane).

The bottom portion of the said equipment bears against the chocks 60 of the lower backup roll 6. The top portion is intended to be used to support the chocks 50 of the upper backup roll 5. The said support equipment 13 is noteworthy in that it can be inserted (once the work rolls have been removed) into the roll stand 2, together with the lower backup roll.

For this purpose, the second coupling means comprise at least one folding element 83 suitable for engaging (only) under a pulling force with the chock 60 of the lower backup roll 6 on the drive side, which in a deployed position P5 of the said folding element 83, allows for the abutment with the chock 60, on the drive side, of the lower backup roll 6 in order to exert a pulling force, allowing the lower backup roll 6 to be inserted into the stand of the rolling mill, in particular during step E5.

in a folded position P6 of the said folding element 83, allows for the uncoupling of the coupling head from the said lower backup roll 6 extracted from the roll stand, during the return movement of the coupling head from the second deployed position P2 to the first retracted position P1.

In a noteworthy manner, the said at least one folding movable element 83 can initially be in the deployed position P5 in that it does not allow a pushing force to be exerted on the roll.

Two of the folding elements 83 can be present and can abut against the two protruding portions 62. The passage from the deployed position P5 to the folded position P6 can take place manually, for example by rotating the said element 83 by a limited angle, for example by a quarter turn. For this purpose, the or each element can have a cavity intended to receive a tool such as a key.

Figure 28:
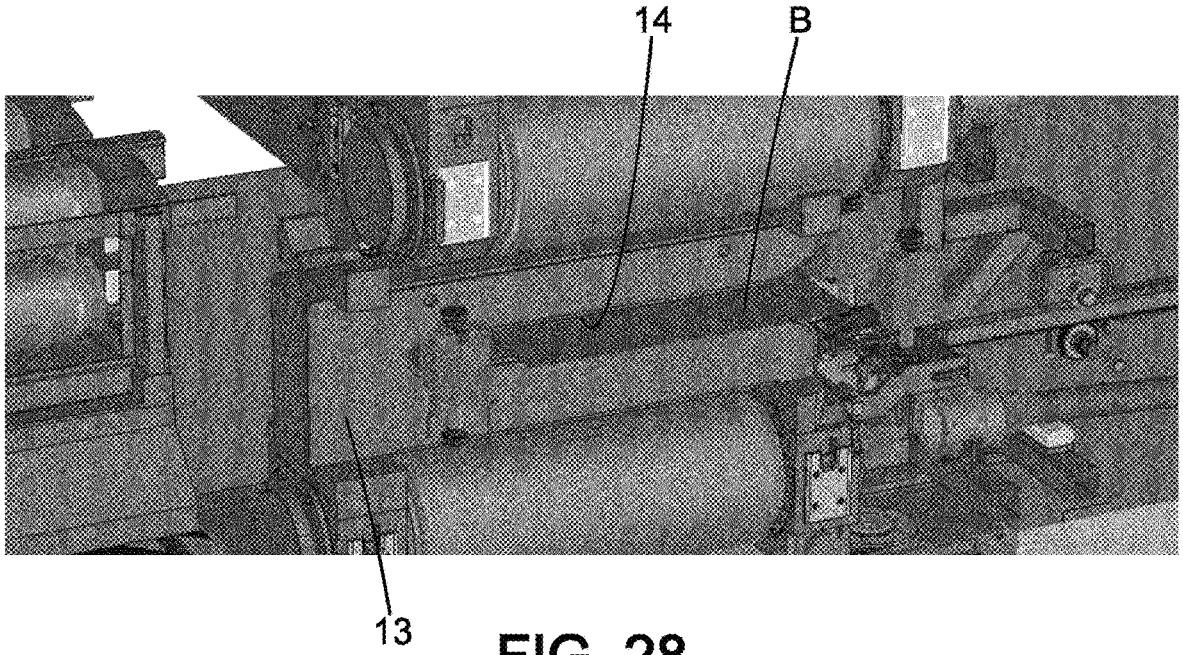
FIG. 28 is a view showing the insertion step wherein the lower backup roll and the said support equipment are inserted together into the roll stand, under the pulling action caused by the return of the coupling head towards the drive side, whereby the metal strip is thus received inside an intermediary clearance of the support equipment.
Figure 29:
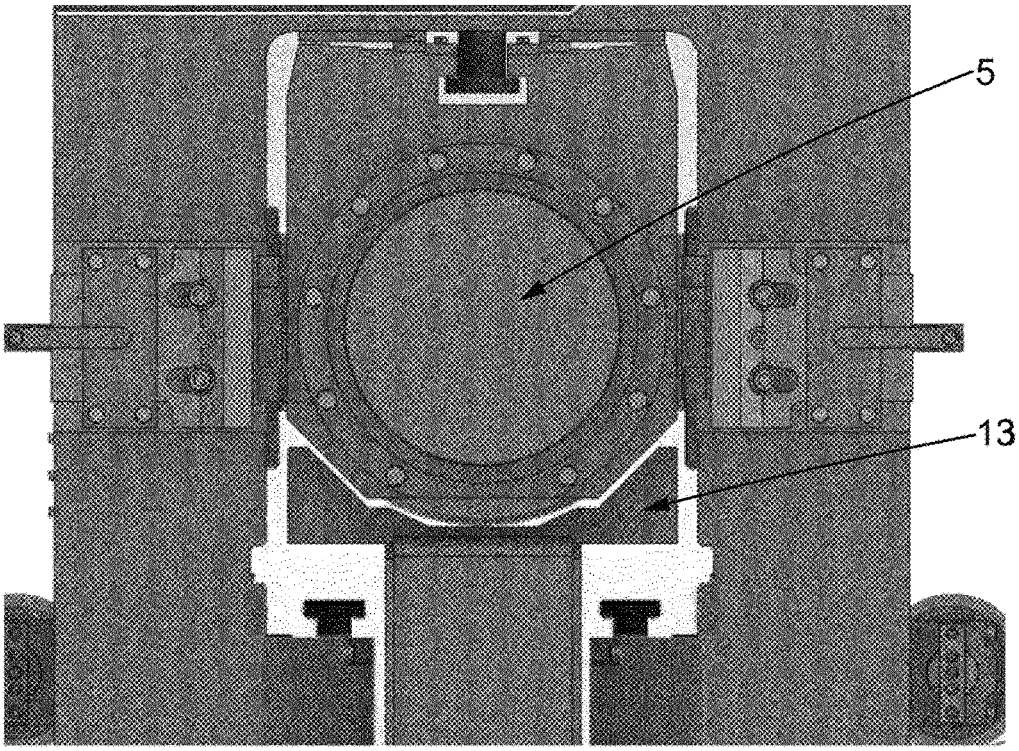
FIGS. 29 and 30 are consecutive views showing the depositing step wherein the upper backup roll is deposited on the top portion of the support equipment by an action of lowering the said upper backup roll.
Figure 30:
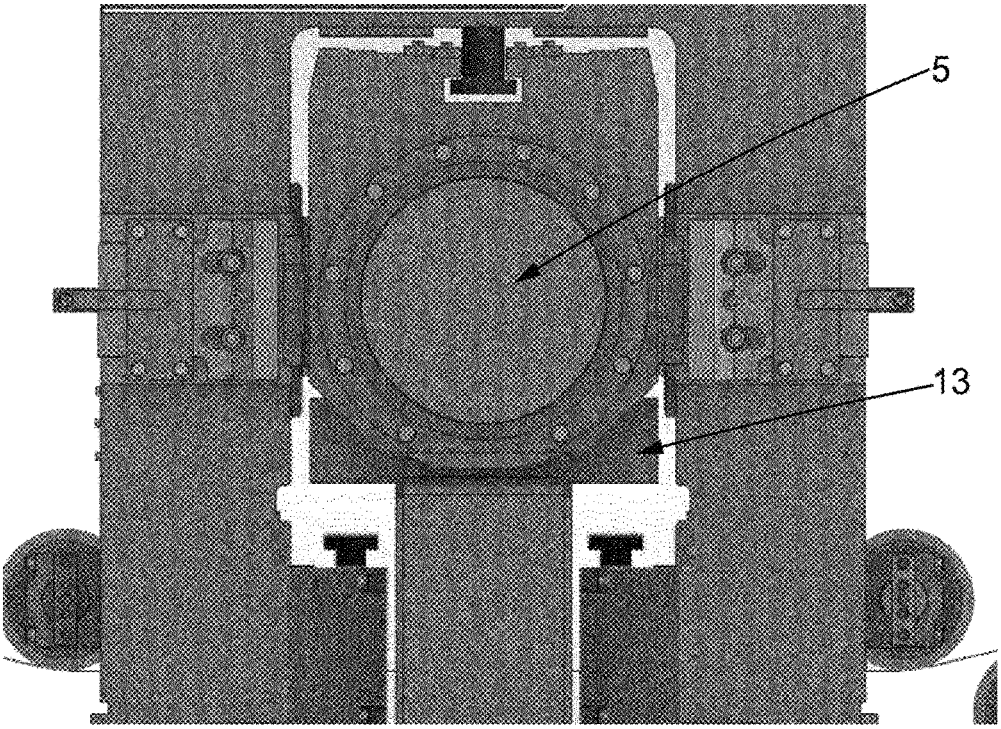
Figure 31:
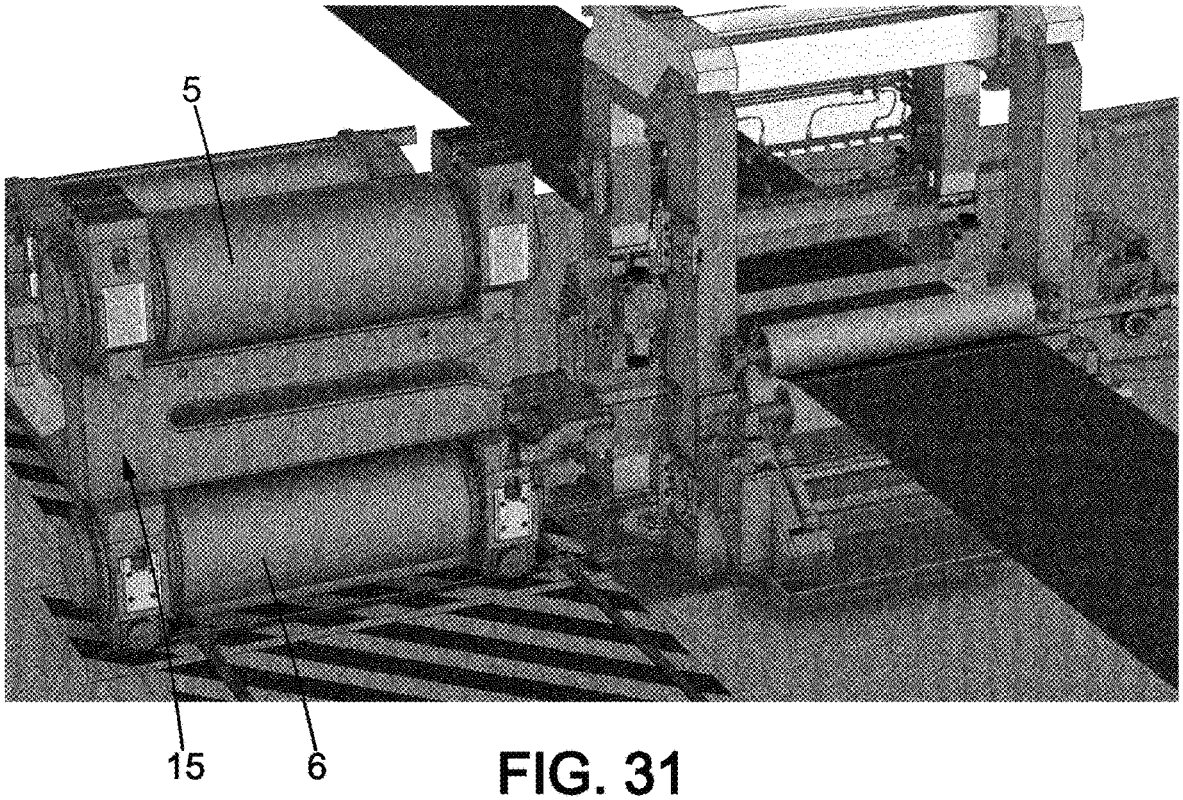
FIG. 31 is a view showing the third extraction step wherein the coupling head jointly extracts, during the pushing action by the actuator, the lower backup roll, the support equipment and the upper backup roll.

The two folding elements in the deployed position P5 thereof allow, during the insertion step E5, for the lower backup roll 6 to be inserted together with the said support equipment 13 supported by the chocks 60 into the roll stand, and as shown in FIG. 28. It should be noted that the metal strip present in the through feed plane of the rolling mill becomes housed in an intermediate clearance 14 of the said support equipment 13.

This then allows the upper backup roll 5 to be deposited onto the said support equipment, by lowering the upper backup roll 5, which action can take place by the deployment of a hydraulic cylinder $V_R$ and until the chocks 50 of the upper backup roll 5 are at rest on the said support equipment 13, whereby the said cylinders $V_R$ are conventionally also used to adjust the pass line.

This is then followed by the third extraction step E7, wherein, via another pushing action from the said actuator 70 on the chock 60, on the drive side, of the lower backup roll 6, the assembly constituted from the lower backup roll 6, the support equipment 13 and the said upper backup roll 5 is extracted, the said coupling head thus being in the second deployed position P2 thereof.

The coupling head 8 is uncoupled by manual action on the folding elements 83, which are passed into the folded position P6 thereof, then by the return of the coupling head to the first retracted position P1.

The upper backup roll 5, the said support equipment 13, then the lower backup roll 6 can thus be withdrawn from the extraction area, from above, using a handling chassis $M_A$, shown in FIG. 1, lifted by a travelling crane.

Other embodiments could clearly have been considered by one of ordinary skill in the art without exiting the scope of the invention as defined by the claims hereinbelow.

NOMENCLATURE

1. Rolling mill installation,

2. Roll stand,

3, 4. Work rolls, respectively one upper and one lower,

5, 6. Backup rolls, respectively one upper and one lower,

30, 40. Work roll chocks, respectively one upper and one lower,

42. Hook at the end, on the drive side, of the lower work roll,

50, 60. Backup roll chocks, respectively one upper and one lower,

31, 41, 51, 61. Chock sliding plates,

62. Protruding portions on the top surface of the chock 60 of the backup roll (on the drive side),

63. Rollers (chocks 60),

25, 26, 27. Sliding plates (frame),

7. Extraction system,

70. Actuator (extraction system)

71, 72. Motorised rack and pinion (extraction system actuator),

8. Coupling head (extraction system),

81. First coupling means (hook rigidly secured to the body of the coupling head) suitable for exerting a pushing force and a pulling force (only) on the lower work roll 4,

82, 83. Second coupling means, including the manually retracting, movable element 82, suitable for exerting a pushing force on the chock 60 of the lower backup roll, and the manually folding elements 83 suitable for exerting a pulling force (only) on the said chock,

84. Prong,

85. Yoke,

86. Stop,

9. Clamping system for clamping the backup rolls,

90. Locking member (clamping system 9),

91. Handle (clamping system),

10. Drive means (for driving the backup rolls),

11. Connection means, on the operator side, between the chocks 30, 40 of the work rolls,

12. Mechanical connection,

13. Support equipment,

14. Clearance of the support equipment through which the metal strip is intended to pass,

15. Tabs,

16. Distal ends (tabs),

17. Oblong aperture,

18. Stud,

20. Support car (work rolls),

B. Metal strip,

E1. First extraction step (for extracting the lower and upper work rolls 34), E2. Return step (coupling head), E3. Second extraction step (for extracting the lower backup roll 6), E4. Positioning step for positioning the support equipment 13 on the chocks of the lower backup roll thus extracted from the roll stand, E5. Joint insertion step for inserting the lower backup roll 6 and the support equipment 13 into the roll stand, E6. Step of depositing the upper backup roll 5 onto the support equipment 13, E7. Third extraction step for extracting the assembly constituted from the lower backup roll 6, the said support equipment 13 and the upper backup roll 5, P1, P2. Retracted position (on the drive side) and deployed position (on the operator side) respectively of the coupling head, P3, P4. Retracted and deployed positions respectively of the said at least one movable element 82, the said deployed position being suitable for exerting a pushing action on the chock of the said backup roll, on the drive side, R3, R4, R6. Support rails of the roll stand suitable for guiding the upper work rolls, lower work roll and lower backup roll respectively, R3', R4'. Support rails of the support car 20, Vc3, Vc4. Bending cylinders, $V_R$. Pass line adjustment cylinder, $V_S$. Hydraulic cylinders (means for applying a clamping force between the chocks of the backup rolls), $M_A$. Handling chassis (backup rolls), $M_T$. Handling chassis (work rolls).

The invention claimed is:

1. A method for changing rolls, the method being carried out in an installation having:

a rolling mill configured to roll a metal strip, the rolling mill including:

a roll stand, a set of the rolls having substantially parallel axes, the set of rolls being superimposed thereon one another, the set of superimposed rolls including a lower work roll and an upper work roll, the lower and upper work rolls defining a nip through which the metal strip passes, and a lower backup roll and an upper backup roll configured to respectively bear against the lower and upper work rolls on an opposite side to a side of the nip, each of the lower and upper work rolls and the lower and upper backup rolls having two ends mounted such that the ends rotate, each of the ends being on a bearing supported by a chock comprising a protruding portion, a guide between the chocks of the lower and upper work rolls and the lower and upper backup rolls and the roll stand along a clamping plane of the rolling mill, a force applicator configured to apply a clamping force between the chocks of the backup rolls, the force applicator comprising hydraulic cylinders, locking members and grooves configured to clamp the chocks of the lower and upper work rolls and the lower and upper backup rolls, locking the chocks in position relative to the roll stand along an axis of the respective roll of the lower and upper work rolls and the lower and upper backup rolls, and allowing the chocks to slide along the guide, along the clamping plane, a motor configured to drive the backup rolls, on a drive side of the roll stand of the rolling mill at which the motor is disposed, and a bracket; and an extraction system configured to extract the lower and upper work rolls and the lower and upper backup rolls provided on the drive side of the rolling mill, the extraction system comprising:

an actuator configured to push the lower and upper work rolls and the lower and upper backup rolls out of the roll stand of the rolling mill when the lower and upper work rolls and the lower and upper backup rolls are extracted, or conversely to pull the lower and upper work rolls and the lower and upper backup rolls into the roll stand when the lower and upper work rolls and the lower and upper backup rolls are inserted, and a coupling head secured to the actuator, the coupling head being situated at an intermediate height between the lower work roll and the lower backup roll when the roll stand is in an open condition in which the upper and lower work rolls and the upper and lower backup rolls are distanced from each other, the coupling head being configured to move in a direction parallel to the lower and upper work rolls and the lower and upper backup rolls, from a first retracted position in which the coupling head is located on the drive side, to a second deployed position in which the coupling head passes through the roll stand and is located on an operator side opposite to the drive side relative to the roll stand, the coupling head comprising:

a rigid hook configured to drive the chock or one of the ends of the lower work roll on the drive side of the rolling mill, and at least one coupling hook configured to drive the chock of the lower backup roll on the drive side of the rolling mill, the at least one coupling hook having a retracted state in which the at least one coupling hook does not drive the chock of the lower backup roll and a deployed state in which the at least one coupling hook drives, by a pushing action, the chock of the lower backup roll, the chocks of the upper and lower work rolls having at least one connector on the operator side creating a mechanical connection between the chocks on the operator side, the method according to the following successive steps when the roll stand of the rolling mill is in the open condition:

extracting, in a first extraction step, the upper work roll and the lower work roll by the pushing action from the actuator on the chock of the lower work roll, on the drive side, the coupling head passing from the first retracted position to the second deployed position, the upper work roll being driven together with the lower work roll via the created mechanical connection, on the operator side, between the chocks of the lower and upper work rolls, the at least one coupling hook of the coupling head being in the retracted state, in which the at least one coupling hook does not drive the chocks of the backup rolls during the pushing action;

passing the at least one coupling hook from the retracted state by manual action on the at least one coupling hook, the coupling head in the first deployed position being accessible on the operator side of the rolling mill;

returning, in a return step, the coupling head back from the second deployed position towards the drive side into the first retracted position;

extracting, in a second extraction step, the lower backup roll from the roll stand by the pushing action from the actuator on the chock of the lower backup roll on the drive side, the coupling head passing from the first retracted position to the second deployed position, the at least one coupling hook being in the deployed state driving the pushing of the chock of the lower backup roll;

positioning, in a positioning step, the bracket on the lower backup roll, the bottom portion of a bracket bearing against the chocks of the lower backup roll, a top portion of the bracket being configured to support the chocks of the upper backup roll, the bracket being configured to be inserted into the roll stand;

inserting, in an inserting step, the lower backup roll and the bracket into the roll stand, by a pulling force exerted by returning the coupling head towards the drive side, from the second deployed position into the first retracted position, the bracket having a clearance through which the metal strip passes when the metal strip is inserted into the roll stand;

depositing, in a depositing step, the upper backup roll on the top portion of the bracket, by an action of lowering the upper backup roll; and extracting, in a third extraction step, the lower backup roll, the bracket, and the upper backup roll by the pushing action from the actuator on the chock of the lower backup roll, on the drive side, wherein the lower work roll and the lower backup roll are distanced from the upper work roll and from the upper backup roll when the metal strip is present along a through feed plane of the rolling mill.

2. The method according to claim 1, wherein:

the roll stand of the rolling mill comprises roll stand support rails on which the chocks of the lower and upper work rolls rest, in the open condition of the roll stand, the method further comprises guiding, by the roll stand support rails, the lower and upper work rolls and the chock thereof during the first extraction step, the second extraction step, and the third extraction step, and the rolling mill further comprises a support car comprising support car support rails, and the method further comprises supporting and guiding the chocks of the lower and upper work rolls, by rollers of the chocks rolling along the roll stand support rails, in a position of the car relative to the rolling mill, and loading the lower and upper work rolls onto the support car when the coupling head reaches the second deployed position during the first extraction step.

3. The method according to claim 2, wherein the rigid hook is rigidly connected to the coupling head, and the method further comprises engaging the rigid hook with a corresponding hook secured to one of the ends of the lower work roll on the drive side by:

exerting the pushing force on the lower work roll during the first extraction step and the passing of the coupling head from the first retracted position to the second deployed position, and exerting the pulling force on the lower work roll during the passing of the coupling head from the second deployed position to the first retracted position.

4. The method according to claim 2, wherein the at least one coupling hook comprises at least one movable hook articulated on a chassis of the coupling head, the at least one movable hook being configured to engage, under a pushing force, with the chock of the lower backup roll, the at least one movable hook being configured to be raised and locked in a retracted position in which the at least one movable hook does not engage with the chock of the lower backup roll on the drive side in the retracted state of the at least one coupling hook, the at least one movable hook being configured to project downwards in a deployed position under the effect of gravity in which the at least one movable hook engages with the protruding portion on a top surface of the chock of the lower backup roll on the drive side in the deployed state of the at least one coupling hook, and wherein:

during the return step, engaging the protruding portion of the chock of the lower backup roll against the at least one movable hook, pivoting the at least one movable hook about the chassis in order for the at least one movable hook to escape from the protruding portion of the chock of the lower backup roll, returning the at least one movable hook to the deployed position on a side of the protruding portion of the chock of the lower backup roll under the effect of gravity, and during the second extraction step, abutting the at least one movable hook against the protruding portion of the chock of the lower backup roll under the effect of the pushing action from the actuator on the side of the protruding portion of the chock of the lower backup roll.

5. The method according to claim 2, wherein the at least one coupling hook comprises at least one folding hook configured to engage, under a hook pulling force, with the chock of the lower backup roll, and the method further comprises:

in a deployed position of the at least one folding hook, abutting the at least the folding hook with the chock on the drive side of the lower backup roll in order to exert the hook pulling force, such that the lower backup roll and the bracket are inserted during the inserting step, and after the third extraction step, in a folded position of the at least one folding hook, uncoupling the coupling head from the lower backup roll extracted from the roll stand, during a return movement of the coupling head from the second deployed position to the first retracted position.

6. The method according to claim 3, wherein the engaging the rigid hook of the coupling head and the corresponding hook of the lower work roll occurs during movements of the car, in a direction perpendicular to the support car support rails.

7. The method according to claim 3, wherein the at least one coupling hook comprises at least one movable hook articulated on a chassis of the coupling head, the at least one movable hook being configured to engage, under a pushing force, with the chock of the lower backup roll, the at least one movable hook being configured to be raised and locked in a retracted position in which the at least one movable hook does not engage with the chock of the lower backup roll on the drive side in the retracted state of the at least one coupling hook, the at least one movable hook being configured to project downwards in a deployed position under the effect of gravity in which the at least one movable hook engages with the protruding portion on a top surface of the chock of the lower backup roll on the drive side in the deployed state of the at least one coupling hook, and wherein:

during the return step, engaging the protruding portion of the chock of the lower backup roll against the at least one movable hook, pivoting the at least one movable hook about the chassis in order for the at least one movable hook to escape from the protruding portion of the chock of the lower backup roll, returning the at least one movable hook to the deployed position on a side of the protruding portion of the chock of the lower backup roll under the effect of gravity, and during the second extraction step, abutting the at least one movable hook against the protruding portion of the chock of the lower backup roll under the effect of the pushing action from the actuator on the side of the protruding portion of the chock of the lower backup roll.

8. The method according to claim 3, wherein the at least one coupling hook comprises at least one folding hook configured to engage, under a hook pulling force, with the chock of the lower backup roll, and the method further comprises:

in a deployed position of the at least one folding hook, abutting the at least the folding hook with the chock on the drive side of the lower backup roll in order to exert the hook pulling force, such that the lower backup roll and the bracket are inserted during the inserting step, and after the third extraction step, in a folded position of the at least one folding hook, uncoupling the coupling head from the lower backup roll extracted from the roll stand, during a return movement of the coupling head from the second deployed position to the first retracted position.

9. The method according to claim 6, wherein the at least one coupling hook comprises at least one movable hook articulated on a chassis of the coupling head, the at least one movable hook being configured to engage, under a pushing force, with the chock of the lower backup roll, the at least one movable hook being configured to be raised and locked in a retracted position in which the at least one movable hook does not engage with the chock of the lower backup roll on the drive side in the retracted state of the at least one coupling hook, the at least one movable hook being configured to project downwards in a deployed position under the effect of gravity in which the at least one movable hook engages with the protruding portion on a top surface of the chock of the lower backup roll on the drive side in the deployed state of the at least one coupling hook, and wherein:

during the return step, engaging the protruding portion of the chock of the lower backup roll against the at least one movable hook, pivoting the at least one movable hook about the chassis in order for the at least one movable hook to escape from the protruding portion of the chock of the lower backup roll, returning the at least one movable hook to the deployed position on a side of the protruding portion of the chock of the lower backup roll under the effect of gravity, and during the second extraction step, abutting the at least one movable hook against the protruding portion of the chock of the lower backup roll under the effect of the pushing action from the actuator on the side of the protruding portion of the chock of the lower backup roll.

10. The method according to claim 1, wherein the at least one coupling hook comprises at least one movable hook articulated on a chassis of the coupling head, the at least one movable hook being configured to engage, under a pushing force, with the chock of the lower backup roll, the at least one movable hook being configured to be raised and locked in a retracted position in which the at least one movable hook does not engage with the chock of the lower backup roll on the drive side in the retracted state of the at least one coupling hook, the at least one movable hook being configured to project downwards in a deployed position under the effect of gravity in which the at least one movable hook engages with the protruding portion on a top surface of the chock of the lower backup roll on the drive side in the deployed state of the at least one coupling hook, and wherein:

during the return step engaging the protruding portion of the chock of the lower backup roll against the at least one movable hook, pivoting the at least one movable hook about the chassis in order for the at least one movable hook to escape from the protruding portion of the chock of the lower backup roll, returning the at least one movable hook to the deployed position on a side of the protruding portion of the chock of the lower backup roll under the effect of gravity, and during the second extraction step, abutting the at least one movable hook against the protruding portion of the chock of the lower backup roll under the effect of the pushing action from the actuator on the side of the protruding portion of the chock of the lower backup roll.

11. The method according to claim 1, wherein the at least one coupling hook comprises at least one folding hook configured to engage, under a hook pulling force, with the chock of the lower backup roll, and the method further comprises:

in a deployed position of the at least one folding hook, abutting the at least the folding hook with the chock on the drive side of the lower backup roll in order to exert the hook pulling force, such that the lower backup roll and the bracket are inserted during the inserting step, and after the third extraction step, in a folded position of the at least one folding hook, uncoupling the coupling head from the lower backup roll extracted from the roll stand, during a return movement of the coupling head from the second deployed position to the first retracted position.

12. The installation according to claim 1, wherein, the chocks on the operator side of the lower and upper work rolls have parallel sliding plates distributed on either side of the axis of the respective roll, the parallel sliding plates being configured to engage with sliding plates secured to two uprights on the operator side of the rolling mill, the at least one connector comprises at least one tab, a proximal end of the at least one tab being secured to one of the lower or upper chocks, the proximal end of the at least one tab being received in a lateral groove made in a body of the respective chock at a back of one of the sliding plates, a distal end of the at least one tab penetrating a groove of the other of the lower or upper chock, at least in a deployed position of the tab, in the open condition of the roll stand.

13. The method according to claim 1, wherein the rigid hook is rigidly connected to the coupling head, and the method further comprises engaging the rigid hook with a corresponding hook secured to one of the ends of the lower work roll on the drive side by:

exerting the pushing force on the lower work roll during the first extraction step and the passing of the coupling head from the first retracted position to the second deployed position, and exerting the pulling force on the lower work roll during the passing of the coupling head from the second deployed position to the first retracted position.

14. The method according to claim 1, wherein in the open condition, the chocks of the upper and lower upper rolls are automatically unclamped.

15. A rolling mill installation comprising:

a rolling mill configured to roll a metal strip, the rolling mill comprising:

a roll stand, a set of superimposed rolls having substantially parallel axes, the set of superimposed rolls comprising a lower work roll and an upper work roll, the lower and upper work rolls defining a nip through which the metal strip passes, and a lower backup roll and an upper backup roll configured to respectively bear against the lower and upper work rolls on an opposite side to a side of the nip, each of the lower and upper work rolls and the lower and upper backup rolls having two ends mounted such that the ends rotate, each of the ends being on a bearing supported by a chock comprising a protruding portion, a guide between the chocks of the lower and upper work rolls and the lower and upper backup rolls and the roll stand along a clamping plane of the rolling mill, a force applicator configured to apply a clamping force between the chocks of the backup rolls, the force applicator comprising hydraulic cylinders, locking members and grooves configured to clamp the chocks of the lower and upper work rolls and the lower and upper backup rolls, locking the chocks in position relative to the roll stand along an axis of the respective roll of the lower and upper work rolls and the lower and upper backup rolls, and allowing the chocks to slide along the guide, along the clamping plane, a motor configured to drive the backup rolls, on a drive side of the roll stand of the rolling mill at which the motor is disposed, and a bracket; and an extraction system configured to extract the lower and upper work rolls and the lower and upper backup rolls provided on the drive side of the rolling mill, the extraction system comprising:

an actuator configured to push the lower and upper work rolls and the lower and upper backup rolls out of the roll stand of the rolling mill when the lower and upper work rolls and the lower and upper backup rolls are extracted, or conversely to pull the lower and upper work rolls and the lower and upper backup rolls into the roll stand when the lower and upper work rolls and the lower and upper backup rolls are inserted, and a coupling head secured to the actuator, the coupling head being situated at an intermediate height between the lower work roll and the lower backup roll when the roll stand is in an open condition in which the upper and lower work rolls and the upper and lower backup rolls are distanced from each other, the coupling head being configured to move in a direction parallel to the lower and upper work rolls and the lower and upper backup rolls, from a first retracted position in which the coupling head is located on the drive side, to a second deployed position in which the coupling head, passes through the roll stand and is located on an operator side opposite to the drive side relative to the roll stand, the coupling head comprising:

a rigid hook configured to drive the chock or one of the ends of the lower work roll on the drive side of the rolling mill, and at least one coupling hook configured to drive the chock of the lower backup roll on the drive side of the rolling mill, the at least one coupling hook having a retracted state in which the at least one coupling hook does not drive the chock of the lower backup roll and a deployed state in which the at least one coupling hook drives, by a pushing action, the chock of the lower backup roll, wherein the chocks of the upper and lower work rolls have at least one connector on the operator side creating a mechanical connection between the chocks on the operator side, wherein the rigid hook and the at least one coupling hook of the extraction system are configured to allow:

successive extractions of the lower and upper work rolls and then successive extractions of the lower and upper backup rolls from the roll stand, and successive insertions of the lower and upper backup rolls and then successive insertions of the lower and upper work rolls into the roll stand, and wherein the at least one coupling hook comprises at least one movable hook articulated on a chassis of the coupling head, the at least one movable hook being configured to engage, under a pushing force, with the chock of the lower backup roll, the at least one movable hook being configured to be raised and locked in a retracted position in which the at least one movable hook does not engage with the chock of the lower backup roll on the drive side of the rolling mill in the retracted state of the at least one coupling hook, the at least one coupling hook being in a deployed state in which the at least one movable hook being configured to project downwards in a deployed position under the effect of gravity the at least one movable hook being manually actuatable to pass from the retracted position to the deployed position, or from the deployed position to the retracted position, the at least one movable hook being configured in the deployed state to engage with the protruding portion on a top surface of the chock of the lower backup roll on the drive side the roll stand;

wherein passing the coupling head from the second deployed position to the first retracted position causes engaging of the protruding portion against the at least one movable hook that pivots about the chassis, in order to escape from the protruding portion, returning the at least one movable hook to the deployed position on a side of the protruding portion of the chock of the lower backup roll under the effect of gravity, and the at least one movable hook, in the position on the other side of the protruding portion, abuts against the protruding portion under the effect of the pushing action from the actuator such that the lower backup roll is extracted.

16. The installation according to claim 15, wherein:

the roll stand of the rolling mill comprises roll stand support rails on which the chocks of the lower and upper work rolls are supported, in the open condition of the roll stand, the support rails being used to guide the lower and upper work rolls and the chock thereof during extracting the rolls inside the roll stand, and the rolling mill comprises a support car having support car support rails configured to support and guide the chocks of the lower and upper work rolls, the chocks of the lower and upper work rolls rolling along the roll stand support rails in a position of the support car relative to the rolling mill, the lower and upper work rolls being configured to be loaded onto the car when the pushing force is exerted by the actuator on the lower and upper work rolls.

17. The installation according to claim 16, wherein the rigid hook is rigidly connected to the coupling head, the rigid hook being configured to engage with a corresponding hook secured to one of the ends of the lower work roll, the rigid hook being configured to:

exert a pushing force on the lower work roll during pushing of the coupling head from the first retracted position to the second deployed position, and exert a pulling force on the lower work roll during passage of the coupling head from the second deployed position to the first retracted position.

18. The installation according to claim 17, wherein the engaging of the rigid hook of the coupling head and the corresponding hook of the lower work roll occurs during movements of the car, in a direction perpendicular to the support car support rails.

19. The installation according to claim 15, wherein the at least one coupling hook comprises at least one folding hook configured to engage, under a pulling force, with the chock of the lower backup roll, on the drive side, such that:

in a deployed position of the at least one folding hook, the chock on the drive side abuts the lower backup roll in order to exert an additional pulling force, allowing the lower backup roll to be inserted into the stand of the rolling mill, and in a folded position of the at least one folding hook, the coupling head is uncoupled from the lower backup roll extracted from the roll stand, during return movement of the coupling head from the second deployed position to the first retracted position.

20. The installation according to claim 19, wherein the at least one folding hook is a member that is manually actuated for the passing from the deployed position of the at least one folding hook to the folded position of the at least one folding hook, or from the folded position to the deployed position.

* * * * *